US012774076B1

(12) United States Patent
Puthumanaillam et al.

(10) Patent No.: US 12,774,076 B1
(45) **Date of Patent: *Oct. 27, 2026**

(54) SYSTEMS AND METHODS FOR AUTONOMOUSLY MANEUVERING A MARINE VESSEL TO A STORAGE STRUCTURE

(71) Applicant: Brunswick Corporation, Mettawa, IL (US)

(72) Inventors: Gokul Puthumanaillam, Champaign, IL (US); Vardhan Dongre, Urbana, IL (US); Phillip M. Renkert, Urbana, IL (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/667,628

(22) Filed: May 17, 2024

(51) Int. Cl.
*B63H 25/04* (2006.01)
*B63H 25/42* (2006.01)

(52) U.S. Cl.
CPC ..... *B63H 25/04* (2013.01); *B63H 25/42* (2013.01)

(58) Field of Classification Search
CPC ..... B63H 25/04; B63H 25/42
See application file for complete search history.

(56) References Cited

U.S. PATENT DOCUMENTS 9,904,293 B1 2/2018 Heap
10,429,845 B2 10/2019 Arbuckle
11,257,378 B2 2/2022 Derginer
11,373,537 B2 6/2022 Derginer
12,298,769 B1 5/2025 Arbuckle
(Continued)

FOREIGN PATENT DOCUMENTS

EP 3158417 B1 * 9/2019 ..... G06V 20/17

OTHER PUBLICATIONS

Diving Info; How to Anchor Your Boat in Wind: A Step by Step Guide; Oct. 16, 2019 https://www.youtube.com/watch?v=YHb1l_6_xOY&t=188s; Youtube; Times: 3:38, 3:50, 4:19, and 4:26 (Year: 2019).*

(Continued)

*Primary Examiner* — Anne Marie Antonucci
*Assistant Examiner* — Nicholas Patrick Langhorne
(74) *Attorney, Agent, or Firm* — Andrus Intellectual Property Law, LLP

(57) ABSTRACT

A system for maneuvering a marine vessel to a target position is provided, the system comprising: a sensor; a marine propulsion system; and one or more hardware processors configured to: determine that the marine vessel is being secured at a target position; receive, from the sensor, information indicative of an impact of one or more environmental influences on the marine vessel; estimate an environmental impact on a course of the marine vessel based on the information indicative of the impact of the one or more environmental influences on the marine vessel; determine a path to the target position based on the environmental impact; determine vessel movements to travel along the path based on the environmental impact; and output the vessel movements to the marine propulsion system, causing the vessel to be propelled to the target position without further intervention from an operator of the marine vessel.

20 Claims, 15 Drawing Sheets

(56) References Cited

U.S. PATENT DOCUMENTS

| | | | | |
|---|---|---|---|---|
| 12,312,044 | B1 | 5/2025 | Messick | |
| 12,377,942 | B1 | 8/2025 | Snipe | |
| 2011/0301825 | A1 | 12/2011 | Grajkowski | |
| 2012/0020527 | A1* | 1/2012 | Abileah | G06V 20/13 382/106 |
| 2014/0126333 | A1* | 5/2014 | Lohrmann | G01S 15/60 367/91 |
| 2019/0084662 | A1 | 3/2019 | Wong | |
| 2019/0317504 | A1* | 10/2019 | Akuzawa | B63B 49/00 |
| 2019/0361457 | A1* | 11/2019 | Johnson | G05D 1/0206 |
| 2021/0094665 | A1* | 4/2021 | Schmid | B63B 1/125 |
| 2021/0269128 | A1 | 9/2021 | Rivers | |
| 2021/0316827 | A1 | 10/2021 | Sirkin | |
| 2022/0234490 | A1 | 7/2022 | Traub | |
| 2022/0268585 | A1 | 8/2022 | Tulgara | |
| 2022/0281569 | A1 | 9/2022 | Traub | |
| 2022/0371503 | A1 | 11/2022 | Traub | |
| 2023/0042962 | A1 | 2/2023 | Inoue | |
| 2023/0219678 | A1 | 7/2023 | Rezac | |
| 2024/0427329 | A1* | 12/2024 | Yamamoto | B63H 25/04 |
| 2025/0229875 | A1 | 7/2025 | Krüger | |

OTHER PUBLICATIONS

TMG Yachts; How to Moor | Mooring retrieval and Bridle Setup on a Catamaran; Jun. 8, 2021; https://www.youtube.com/watch?v=_wFNhPideWU&t=85s; Youtube; Time: 1:52 (Year: 2021).*

Voermans J. J., et al. "Estimating wind speed and direction using wave spectra", Accepted article online Feb. 5, 2020, Journal of Geophysical Research: Oceans, 125.

Jiang, Haoyu, "Wind speed and direction estimation from wave spectra using deep learning", Published Jan. 3, 2022, Atmos. Meas. Tech., 15, 1-9, 2022.

Leonard et al., "Picking Up a Mooring" https://www.boatus.com/expert-advice/expert-advice-archive/2015/december/picking-up-a-mooring.

Likozar et al., "Smart Anchor Buoy: Design and Implementation", Dec. 2023, 2023 IEEE Third International Conference on Signal, Control and Communication (SCC), pp. 1-5. https://ieeexplore.ieee.org/abstract/document/10527710 ( Year: 2023).

Boating Basics, "How to anchor a boat—Step-by-step guide to anchoring", Apr. 11, 2023, You Tube, https://www.youtube.com/watch?v=ZpQeVN 10ihg (Year: 2023).

* cited by examiner

SYSTEMS AND METHODS FOR AUTONOMOUSLY MANEUVERING A MARINE VESSEL TO A STORAGE STRUCTURE

FIELD

The present disclosure generally relates to systems and methods for autonomously maneuvering a marine vessel to a storage structure.

BACKGROUND

The following U.S. Patents are incorporated herein by reference, in entirety:

U.S. Pat. No. 9,904,293 discloses a system for automatically trailering a marine vessel includes a set of coded tags coupled to a boat trailer, each coded tag storing data regarding its location on the trailer. A tag reader is located aboard the marine vessel, the tag reader estimating a first distance between the tag reader and a first coded tag in the set of coded tags and estimating a second distance between the tag reader and a second coded tag in the set of coded tags. A position determination module uses the first and second estimated distances to determine a position and a heading of the marine vessel and a position and a heading of the trailer in a given coordinate system. A feedback control module calculates a difference between the position of the marine vessel and the position of the trailer and a difference between the heading of the marine vessel and the heading of the trailer and determines marine vessel movements required to minimize the position difference and the heading difference. A marine propulsion system automatically actuates a marine propulsion device to produce the required marine vessel movements and thereby propels the marine vessel onto the trailer.

U.S. Pat. No. 10,429,845 discloses a system controls a position of a marine vessel near an object, the marine vessel being movable with respect to first, second, and third axes that are perpendicular to one another and define six degrees of freedom of potential vessel movement. The system includes a location sensor that measures a present location of the marine vessel and a heading sensor that determines a present heading of the marine vessel. A control module is in signal communication with the location sensor and the heading sensor. A marine propulsion system is in signal communication with the control module. The control module determines marine vessel movements that are required to translate the marine vessel from the present location to the target location and to rotate the marine vessel from the present heading to the target heading. The control module controls the propulsion system to produce components of the required marine vessel movements no more than two degrees of freedom at a time during a given iteration of control.

SUMMARY

In accordance with some embodiments of the disclosed subject matter, a system for maneuvering a marine vessel to a target position is provided, the system comprising: a sensor; one or more hardware processors configured to: determine that the marine vessel is being secured at a target position; receive, from the sensor, information indicative of an impact of one or more environmental influences on the marine vessel; estimate an environmental impact on a course of the marine vessel based on the information indicative of the impact of the one or more environmental influences on the marine vessel; determine a path to the target position based on the environmental impact; and cause the marine vessel to maneuver to the target position based on the path.

In accordance with some embodiments of the disclosed subject matter, a system for maneuvering a marine vessel to a target position is provided, the system comprising: a sensor; a marine propulsion system comprising one or more propulsion devices; and one or more hardware processors configured to: determine that the marine vessel is being secured at a target position; receive, from the sensor, information indicative of an impact of one or more environmental influences on the marine vessel; estimate an environmental impact on a course of the marine vessel based on the information indicative of the impact of the one or more environmental influences on the marine vessel; determine a path to the target position based on the environmental impact; determine marine vessel movements to cause the marine vessel to travel along the path based on the environmental impact; and output the marine vessel movements to the marine propulsion system, thereby causing the marine propulsion system to actuate the one or more propulsion devices to propel the marine vessel to the target position without further intervention from an operator of the marine vessel.

In some embodiments, the system further comprises: an imaging device, wherein the imaging device is configured to be mounted to the marine vessel with an associated field of view of a marine environment of the marine vessel; and wherein the one or more hardware processors are further configured to: receive image data from the imaging device; determine that the marine vessel is being trailered on a boat trailer; and identify, based on the image data, a position associated with the boat trailer as the target position.

In some embodiments, the one or more environmental influences includes wind, and the environmental impact on the course of the marine vessel includes an impact of the wind on the course of the marine vessel.

In some embodiments, the system further comprises: a display device; and wherein the one or more hardware processors are further configured to: present, using the display device, a user interface element that represents the path and prompts an operator of the marine vessel to control at least one propulsion device of the marine vessel to navigate to the target position.

In some embodiments, the sensor comprises an imaging device, the imaging device is configured to be mounted to the marine vessel with an associated field of view of a marine environment of the marine vessel, and the information indicative of the impact of the one or more environmental influences on the marine vessel comprises image data generated by imaging device; and wherein the one or more hardware processors are further configured to: receive, from the imaging device, a sequence of image data that includes at least one object in the marine environment; and estimate the environmental impact on the course of the marine vessel based on movement of the at least one object in the sequence of image data.

In some embodiments, imaging device comprises a digital camera configured to generate a two-dimensional image of a portion of the marine environment within the associated field of view, and wherein the portion of the marine environment within the associated field of view includes a region forward of a bow of the marine vessel.

In some embodiments, the one or more hardware processors are further configured to: determine movement of the at least one object during a period of time depicted in the sequence of images based on an optical flow of at least one point of interest on the at least one object in the sequence of image data.

In some embodiments, the one or more hardware processors are further configured to: cause the marine vessel to drift for at least a predetermined period of time, including the period of time depicted in the sequence of images; determine ego motion of the marine vessel during the period of time depicted in the sequence based on the movement of the at least one object during the period of time depicted in the sequence; and estimate the environmental impact on the course of the marine vessel based on the ego motion of the marine vessel during the period of time depicted in the sequence.

In some embodiments, the at least one object includes a wave; and wherein the one or more hardware processors are further configured to: determine movement of the wave during the period of time depicted in the sequence based on an optical flow of a point of interest on the wave in the sequence of image data; and estimate the environmental impact on the course of the marine vessel based on the movement of the wave during the period of time depicted in the sequence.

In some embodiments, the sensor comprises a wind sensor; and wherein the one or more hardware processors are further configured to: receive, from the sensor, wind data; and estimate the environmental impact on the course of the marine vessel based on the wind data.

In some embodiments, the one or more hardware processors are further configured to: identify a target location in a marine environment of the marine vessel that facilitates securing the marine vessel at the target position using only input from a first input device manipulatable to provide user control input to control thrust of a propulsion device of the marine vessel, without input to a second input device manipulatable to provide user control input to control steering of the propulsion device; and determine a path to the target location based on the environmental impact.

In some embodiments, a direction of the environmental impact is toward the target position, and the target location is a location from which the environmental impact is predicted to cause the marine vessel to drift to the target position; and wherein the one or more hardware processors are further configured to: determine a first portion of the path to the target position based on the environmental impact and the target location; determine that the marine vessel has reached the target location; and in response to determining that the marine vessel has reached the target location, cause the marine vessel to drift to the target position.

In some embodiments, the system further comprises: a display device; and wherein the one or more hardware processors are further configured to: present, using the display device, a visualization of the first portion of the path; and in response to determining that the marine vessel has reached the target location, prompt, using the display device, an operator of the marine vessel to control at least one propulsion device of the marine vessel to allow the marine vessel to drift.

In some embodiments, the one or more hardware processors are further configured to: identify a set of approach angles to the target position that facilitate securing the marine vessel at the target position based on the environmental impact, wherein the set of approach angles comprises the path to the target position and a plurality of other viable paths to the target position.

In some embodiments, the system further comprises: a display device; and wherein the one or more hardware processors are further configured to: present, using the display device, a visualization of the set of approach angles to the target position using the display device as a portion of a cone.

In some embodiments, the one or more hardware processors are further configured to: determine that the marine vessel is being docked at a dock; and identify appropriate maneuvers to approach the dock based on the environmental impact, wherein the appropriate maneuvers facilitate safe docking of the marine vessel based on a prevailing direction of the environmental impact.

In some embodiments, the system further comprises: a display device; and wherein the one or more hardware processors are further configured to: present, using the display device, a visualization of appropriate maneuvers.

In some embodiments, the one or more hardware processors are further configured to: determine that the marine vessel is being moored at a mooring ball, wherein the target position is a position associated with the mooring ball; and identify appropriate maneuvers to approach the mooring ball based on the environmental impact, wherein the appropriate maneuvers facilitate approaching the mooring ball from a direction that is opposite of a direction of the environmental impact, and the environmental impact is predicted to cause the marine vessel to drift in an aft direction away from the mooring ball.

In some embodiments, the one or more hardware processors are further configured to: determine that the marine vessel is being anchored, wherein the target position is a position at which an anchor is dropped during anchoring; and identify appropriate maneuvers to approach the target position based on the environmental impact, wherein the appropriate maneuvers facilitate approaching the target position from a direction that is opposite of a direction of the environmental impact.

In some embodiments, the one or more hardware processors are further configured to: cause the marine vessel to maneuver in a reverse direction away from the target position, such that the anchor digs into a floor of a body of water in which the marine vessel is being anchored.

In some embodiments, the system further comprises: a vision system comprising a plurality of imaging devices, wherein each of the plurality of imaging devices is configured to be mounted to the marine vessel with an associated field of view of a marine environment of the marine vessel; and wherein the one or more hardware processors are further configured to: receive image data from an imaging device of the plurality of imaging devices; determine that the marine vessel is being trailered on a boat trailer; and identify, based on the image data, a position associated with the boat trailer as the target position.

In some embodiments, the one or more hardware processors are further configured to: output instructions to the marine propulsion system that cause the marine vessel to drift for at least a predetermined period of time, including the period of time depicted in the sequence of images; determine ego motion of the marine vessel during the period of time depicted in the sequence based on the movement of the at least one object during the period of time depicted in the sequence; and estimate the environmental impact on the course of the marine vessel based on the ego motion of the marine vessel during the period of time depicted in the sequence.

In some embodiments, the imaging device comprises a stereoscopic depth camera configured to generate three-dimensional data of a portion of the marine environment within the associated field of view, and wherein the portion of the marine environment within the associated field of view includes a region forward of a bow of the marine vessel; and wherein the one or more hardware processors are further configured to: determine movement of the at least one object during a period of time depicted in the sequence of images based on a first 3D location of at least one point of interest on the at least one object at a beginning of the sequence of images and a second 3D location of the least one point of interest on the at least one object at an end of the sequence of images.

In some embodiments, the one or more hardware processors are further configured to: identify a target location in a marine environment of the marine vessel that facilitates securing the marine vessel at the target position using only thrust commands to the one or more propulsion devices, without steering commands, wherein a direction of the environmental impact is toward the target position, and the target location is a location from which the environmental impact is predicted to cause the marine vessel to drift to the target position; determine a first portion of the path to the target position based on the environmental impact and the target location; determine that the marine vessel has reached the target location; and in response to determining that the marine vessel has reached the target location, output instructions to the marine propulsion system that cause the marine vessel to drift to the target position.

In some embodiments, the one or more hardware processors are further configured to: determine the path to the target position using the set of approach angles as a constraint.

In some embodiments, the one or more hardware processors are further configured to: determine that the marine vessel is being docked at a dock; identify appropriate maneuvers to approach the dock based on the environmental impact, wherein the appropriate maneuvers facilitate safe docking of the marine vessel based on a prevailing direction of the environmental impact; and determine the path based on the appropriate maneuvers. [xx] In some embodiments, the one or more hardware processors are further configured to: determine that the marine vessel is being moored at a mooring ball, wherein the target position is a position associated with the mooring ball; identify appropriate maneuvers to approach the mooring ball based on the environmental impact, wherein the appropriate maneuvers facilitate approaching the mooring ball from a direction that is opposite of a direction of the environmental impact, and the environmental impact is predicted to cause the marine vessel to drift in an aft direction away from the mooring ball; and determine the path based on the appropriate maneuvers.

In some embodiments, the one or more hardware processors are further configured to: determine that the marine vessel is being anchored, wherein the target position is a position at which an anchor is dropped during anchoring; identify appropriate maneuvers to approach the target position based on the environmental impact, wherein the appropriate maneuvers facilitate approaching the target position from a direction that is opposite of a direction of the environmental impact; and determine the path based on the appropriate maneuvers.

In some embodiments, the one or more hardware processors are further configured to: output marine vessel movements to the marine propulsion system that cause the marine vessel to maneuver in a reverse direction away from the target position subsequent to the anchor being deployed at the target position, such that the anchor digs into a floor of a body of water in which the marine vessel is being anchored.

In accordance with some embodiments of the disclosed subject matter, a method for maneuvering a marine vessel to a target position is provided, the method comprising: determining that the marine vessel is being secured at a target position; receiving, from a sensor, information indicative of an impact of one or more environmental influences on the marine vessel; estimating an environmental impact on a course of the marine vessel based on the information indicative of the impact of the one or more environmental influences on the marine vessel; determining a path to the target position based on the environmental impact; and causing the marine vessel to maneuver to the target position based on the path.

In accordance with some embodiments of the disclosed subject matter, a method for maneuvering a marine vessel to a target position is provided, the method comprising: determining that the marine vessel is being secured at a target position; receiving, from a sensor, information indicative of an impact of one or more environmental influences on the marine vessel; estimating an environmental impact on a course of the marine vessel based on the information indicative of the impact of the one or more environmental influences on the marine vessel; determining a path to the target position based on the environmental impact; determining marine vessel movements to cause the marine vessel to travel along the path based on the environmental impact; and outputting the marine vessel movements to a marine propulsion system comprising one or more propulsion devices, thereby causing the marine propulsion system to actuate the one or more propulsion devices to propel the marine vessel to the target position without further intervention from an operator of the marine vessel.

BRIEF DESCRIPTION OF THE DRAWINGS

The present disclosure is described with reference to the following drawings.

DETAILED DESCRIPTION

Loading a boat onto a trailer can be a difficult and intimidating process, especially for inexperienced boaters. For example, the bow of the boat can obstruct a view of the trailer from the helm. This can make it more difficult to align the boat and the trailer, and may require assistance from a person that is not on the boat. Similar issues can cause storing a boat using another storage structure (e.g., docking, berthing at a slip, loading onto a boat lift, etc.). These difficulties can be exacerbated by wind and/or current that affects movement of the boat and how it handles when attempting to trailer, dock, or otherwise secure the boat. For example, wind can push the boat offline as it approaches the trailer or dock, and it can be difficult (especially for inexperienced boaters) to successfully compensate for the impact of the wind.

In some embodiments, mechanisms described herein can utilize an imaging device of a marine vessel (and/or other sensors) to estimate an impact of wind and/or water current on the marine vessel during operations to secure the marine vessel (e.g., on a trailer, at a dock, etc.). Additionally, in some embodiments, mechanisms described herein can identify a path or paths that the marine vessel can use to approach a storage location that facilitates successfully (e.g., safe, efficient, and accurate) positioning the marine vessel at the storage location (e.g., with an operator controlling the vessel, with an autonomy system controlling the vessel, etc.).

Figure 1:
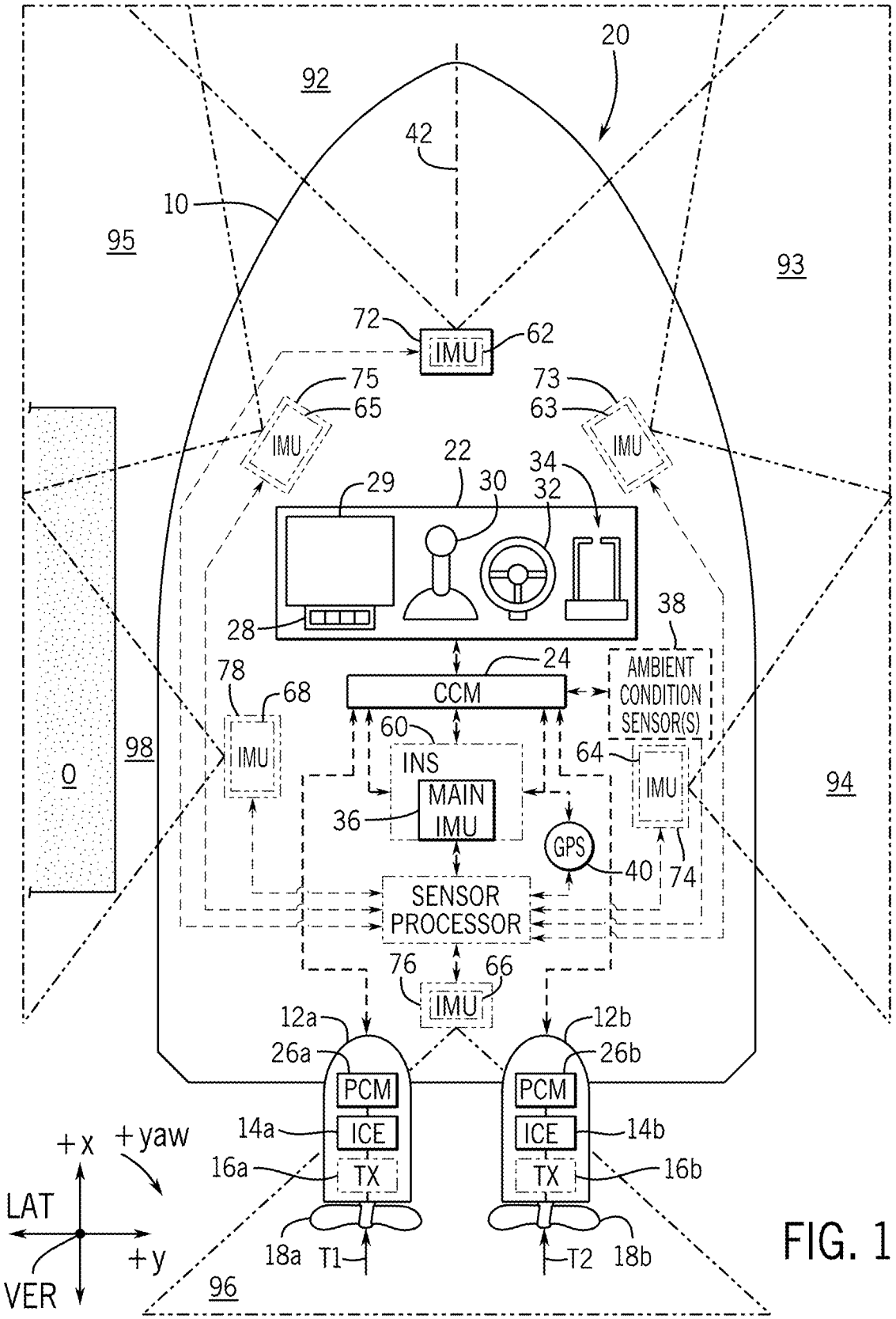
FIG. 1 shows an example of a propulsion system on a marine vessel in accordance with some embodiments of the disclosure.

FIG. 1 shows an example of a schematic representation of a propulsion system on a marine vessel in accordance with some embodiments of the disclosed subject matter. FIG. 1 shows a marine vessel 10 equipped with a propulsion system 20 on marine vessel 10 configured in accordance with some embodiments of the disclosed subject matter. In some embodiments, propulsion system 20 can be configured to operate, for example, in a joysticking mode in which a joystick is operated by a user to control vessel movement within an x/y plane, among other modes (e.g., as described hereinbelow). In some embodiments, propulsion system 20 can include first and second propulsion devices 12*a*, 12*b* that produce first and second thrusts T1, T2 to propel the vessel 10. First and second propulsion devices 12*a*, 12*b* are illustrated as outboard motors, but can alternatively be inboard motors, stern drives, jet drives, pod drives, any other suitable propulsion device, or combinations thereof. Each propulsion device can be provided with an engine 14*a*, 14*b* operatively connected to a transmission 16*a*, 16*b*, in turn, operatively connected to a propeller 18*a*, 18*b*.

In some embodiments, vessel 10 can also house various control elements that comprise part of the marine propulsion system 20. For example, marine propulsion system 20 can comprise an operation console 22 in signal communication (e.g., via a controller area network (CAN) bus) with a controller 24, such as a command control module (CCM), and with propulsion control modules (PCM) 26*a*, 26*b* associated with the respective propulsion devices 12*a*, 12*b*. Each of controller 24 and PCMs 26*a*, 26*b* can include memory and a programmable processor. For example, each control module 24, 26*a*, 26*b* can include one or more processors communicatively connected to a respective storage system comprising a computer-readable medium that includes volatile and/or nonvolatile memory upon which computer-readable code and data can be stored. Additionally or alternatively, in some embodiments, a processor(s) of one or more of control modules 24, 26*a*, 26*b* can be communicatively connected to a shared storage system comprising a computer-readable medium that includes volatile and/or nonvolatile memory upon which computer-readable code and data can be stored.

Note that although mechanisms described herein are generally described in connection with an internal combustion engine (ICE) propulsion system that includes a powerhead implemented using an ICE engine, mechanisms described herein can be used in connection with a propulsion system that includes any other suitable powerhead(s), such as one or more electric motors, or any suitable combination of powerheads. For example, propulsion devices 12*a*, 12*b* can be replaced by, or used in combination with, one or more propulsion devices that produce thrust to propel vessel 10 using an electric motor, such as an electric outboard motor, electric inboard motor, electric stern drive, electric jet drive, electric pod drive, any other suitable propulsion device, or combinations thereof, that is implemented using an electric motor (e.g., which can be implemented as a motor that is directly connected to a propulsor shaft without a transmission, such as transmission 16*a*, 16*b*).

In some embodiments, operation console 22 can include any suitable number of user input devices, such as, a keypad 28, a joystick 30, a steering wheel 32, one or more throttle/shift levers 34, etc., and any suitable number of output devices, such as a display 29, a heads-up display (HUD) 35, one or more speakers (not shown; e.g., a conventional speaker(s), an underwater speaker(s), etc.), one or more sound producing devices (e.g., an air horn(s), a bell(s), a whistle(s), etc.), etc. In some embodiments, each of the input devices can be configured to input commands to controller 24, which can, in turn, communicate control instructions to first and second propulsion devices 12*a*, 12*b* by communicating with PCMs 26*a*, 26*b*. In some embodiments, steering wheel 32 and throttle/shift lever(s) 34 can function in a conventional manner, such that rotation of steering wheel 32, for example, activates a transducer that provides a signal to controller 24 regarding a desired direction of the vessel 10. Controller 24 can, in turn, send signals to PCMs 26*a*, 26*b* (and/or a thrust vector module(s) (TVMs), or additional modules if provided), which in turn can activate steering actuators to achieve desired orientations of propulsion devices 12*a*, 12*b*. In some embodiments, propulsion devices 12*a*, 12*b* can be independently steerable about a respective steering axis. Throttle/shift lever(s) 34 can send signals to controller 24 regarding a desired gear (e.g., forward, reverse, or neutral) of transmissions 16*a*, 16*b* and desired rotational speed (and/or any other value indicative of a thrust command) of engines 14*a*, 14*b* of propulsion devices 12*a*, 12*b*. Controller 24 can, in turn, send signals to PCMs 26*a*, 26*b*, which in turn activate electromechanical actuators in transmissions 16*a*, 16*b* and engines 14*a*, 14*b* for shift and throttle, respectively. A manually operable input device that facilitates control along multiple degrees of freedom, such as joystick 30, can also be used to provide signals to controller 24. In some embodiments, joystick 30 can be used to allow an operator of vessel 10 to manually maneuver vessel 10 along a particular degree of freedom, such as to achieve lateral translation or rotation of vessel 10, or along multiple particular degrees of freedom, such as to achieve translation along a direction other than fore or aft (e.g., a direction not aligned with a heading of the vessel) or simultaneous translation and rotation of vessel 10. For example, joystick 30 can be used to allow an operator of vessel 10 to maneuver vessel 10, such as to achieve isolated movement in a ±x direction (e.g., translational movement in a forward or backward direction), a ±y direction (e.g., translational movement in a lateral direction to starboard or port), and/or a ±yaw direction (e.g., rotational movement to starboard or port). In a more particular example, joystick 30 can be used to allow an operator of vessel 10 to maneuver vessel 10 to achieve lateral translation of vessel 10 (e.g., movement along the ±y direction, without movement along the ±x or ±yaw directions), rotation of the vessel 10 (e.g., movement along the ±yaw direction, without movement along the ±x or ±y directions), or combinations of such maneuvers (e.g., movement along the ±y while simultaneously rotating around the ±yaw direction, without movement along the ±x direction).

In some embodiments, output devices, such as display 29, speakers, etc., can be configured to present (e.g., visually, audibly, etc.) any suitable data, information, image data (e.g., images captured by one or more devices that include an image sensor(s)), received from controller 24, from another controller or processor, and/or generated based on data and/or information received from controller 24, another controller, and/or processor. In some embodiments, display 29 can be any suitable display, such as a multi-function display (MFD). In some embodiments, display 29 can be used to present a user interface, which can be implemented as a touchscreen or display that is capable of receiving input via a touchscreen. In some embodiments, one or more other input devices can be used to interact with a user interface (e.g., a graphical user interface) presented by display 29, such as a keypad (e.g., keypad 28), a keyboard, a track ball, a track pad, any other suitable user input device, and/or suitable combination of user input devices. In some embodiments, vessel 10 can include multiple displays 29, which can be integrated into operation console 22, integrated into another portion of vessel 10, and/or mechanically mounted to operation console 22 or another portion of vessel 10. In some embodiments, display 29 can be used to present alerts, menus, operational data (e.g., throttle, speed, heading, engine output, etc.), maps, charts, settings that can be used to configure another display, etc. In some embodiments, display 29 can be omitted. For example, where a mobile device, such as a tablet computer, laptop computer, head-mounted display, etc. is configured to present a user interface of vessel 10.

In some embodiments, propulsion system 20 can also include one or more imaging devices 72, 73, 74, 75, 76, and 78, which can be implemented using any suitable imaging device. For example, in some embodiments, one or more of imaging devices 72-78 can be implemented using a two-dimensional (2D) imaging device, such as a digital camera having an image sensor (e.g., a color image sensor and/or monochrome image sensor) implemented using a conventional digital image sensor (e.g., a CMOS image sensor, a CCD image sensor). Such an imaging device can be configured to generate 2D images (e.g., color images, monochrome images, etc.) of a portion of an environment of the marine vessel that is within a field of view of the imaging device (e.g., partial FOVs 92, 93, 94, 95, 96, and 98 shown in FIG. 1, associated with imaging devices 72, 73, 74, 75, 76, and 78 respectively). Additionally or alternatively, in some embodiments, one or more of imaging devices 72-78 can be implemented using a depth sensing device, such as a 3D camera, which can be used to determine a three-dimensional location of an object and/or other feature of an environment (e.g., a water surface) that is within a field of view of the depth sensing device (e.g., partial FOVs 92, 93, 94, 95, 96, and 98) with respect to the location of the depth sensing device (e.g., distance to various points on an object and a direction associated with each of the various points).

In some embodiments, imaging devices 72-78 can form a portion of a vision system associated with vessel 10 (although the vision system may be configured to use sensing modes other than visible light, such as sound-based sensing, radio-based sensing, infrared-based sensing, etc.). Although a limited number of imaging devices are shown (e.g., one perpendicular to each of the bow, stern, and port and starboard sides the vessel 10, and two positioned at an angle between the bow and sides), fewer or more sensors can be provided at each location and/or provided at other locations, such as on a hardtop of the vessel 10. In some embodiments, imaging devices 72-78 can be used to determine a three-dimensional location of an object and/or other feature of an environment (e.g., a water surface) that is within a field of view of the imaging device. For example, imaging devices 72-78 can be implemented using one or more of depth cameras (e.g., implemented using stereoscopic imaging techniques, structured light imaging techniques, continuous-wave time-of-flight imaging techniques, direct time-of-flight imaging techniques, etc.), three-dimensional laser range finders (e.g., implemented using light detection and ranging (lidar) techniques), radars, sonars, and/or other devices individually capable of determining both the distance and direction to points on an object and/or other feature relatively accurately (e.g., on the order of several to tens of centimeters (cm) at relatively close ranges on the order of several to tens of meters, such as an accuracy of about +/−3 cm at 5 meters (m) and +/−13 cm at 10 m for stereoscopic cameras), e.g., the relative position of various points on an object O (such as a dock, a seawall, a slip, another vessel, a person, a portion of a bridge, a portion of a dam, a relatively large rock, a tree, etc.) with respect to each imaging device 72-78 having a field of view that includes object O. In some embodiments, a 3D location of object O and/or various points on object O with respect to vessel 10 can be determined (e.g., by a sensor processor 70) using the location of object O and/or various points on object O determined by one or more of imaging devices 72-78. Note that, as described above, imaging device 72 (and/or any other imaging devices) can be implemented as a 2D digital camera that is not configured to generate depth information. Additionally, in some embodiments, one or more of imaging devices 72-78 can be omitted and/or one or more additional imaging devices can be included (e.g., having a different FOV). For example, marine vessel 10 can include a single 2D camera with a FOV that includes an area in front of a bow of marine vessel 10.

In some embodiments, a calibration process can be performed to determine a set of transforms that can be used to convert a location from a local coordinate system used by a particular imaging device (sometimes referred to herein as a camera coordinate system, although it can be a coordinate system used by another type of imaging device, such as a lidar or sonar-based sensor) to the corresponding location in a global coordinate system used by vessel 10 (e.g., used to perform autonomous navigation processes, such as automatically guiding vessel 10 during docking, automatically guiding vessel 10 during trailer loading or unloading, automatically avoiding collisions with objects via a virtual bumper or buffer zone, autonomous navigation through areas that include other vessels and/or other obstacles, etc.). The camera coordinate system can define a local reference frame for a particular camera (or other type of imaging device), and the global coordinate system can define a reference frame to which each camera (or other type of imaging device) is calibrated, which can be referred to as a common reference frame, a global reference frame, or a world reference frame (note that the global coordinate system can be independent and distinct from the geographical coordinate system of latitude and longitude often used to designate locations on Earth). In some embodiments, the global coordinate system can generally coincide with the vessel 10. For example, X and Y axes of the global coordinate system can be aligned with a longitudinal axis, x, and a latitudinal axis, y, of vessel 10, respectively, and a Z axis can be aligned with an axis, z, that is orthogonal to the x and y axes).

Autonomous and/or advanced operator assistance (sometimes referred to as semi-autonomous) controls for improved vessel handling qualities generally requires a relatively accurate ability to identify objects in an environment of vessel 10, often using multiple imaging devices (e.g., depth sensors) mounted on vessel 10. In general, such imaging devices can be positioned to detect objects in the marine environment surrounding marine vessel 10, such as a trailer, a dock, a mooring ball, another vessel, a wave(s), a floating object(s), or other object in environment, in the current path, and/or in other potential paths of vessel 10. Each imaging device can provide location information of features within its field of view relative to its own frame of reference (e.g., in the camera coordinate system associated with that imaging device) and/or in a common frame of reference (e.g., in the global coordinate system). For example, the location information can be transformed from the respective camera coordinates at the camera (or other imaging device) and/or at a controller (e.g., sensor processor 70) using one or more transforms derived during a calibration procedure. Depending on the type of imaging device(s), the application of use, boat size, hull shape, etc., multiple sensor types and sensor locations may be required to provide adequate sensing around the marine vessel for operation in all marine environments. To create a cohesive dataset that can be used for purposes of vessel control and vessel navigation, including autonomous vessel navigation and automatic maneuver-limiting control (e.g., velocity limiting for object avoidance, maintenance of a buffer zone, etc.), information from multiple sources (e.g., multiple depth sensors, multiple types of depth sensors, proximity sensors, etc.), can be translated to a common reference frame. To accurately translate the information to the common reference frame typically requires precise knowledge of the posture (e.g., including 3D location, installation attitude, and/or orientation) of each device relative to the common reference frame such that the information received from each device can be translated appropriately. Regardless of what type of model(s) is being generated, the relevant device installation posture of each device on the marine vessel must be known so that the location information from each respective device can be properly interpreted for navigation purposes. Note that the installation posture of each device can be calculated or otherwise determined explicitly, however, such information is generally difficult to determine with sufficient accuracy. Alternatively, the installation posture of each device can be implicit in the transforms determined during a calibration procedure (e.g., transforms that are optimized using machine learning techniques may not require explicit knowledge of the location of the devices). In some embodiments, a calibration procedure can begin with an initial estimate of camera poses (e.g., based on measurement and/or a CAD model), and the calibration procedure can include refining the initial estimate (e.g., via an optimization algorithm).

In some embodiments, vessel 10 can have a main inertial measurement unit (IMU) 36 installed at a known location on the marine vessel. Referencing the example in FIG. 1, main IMU 36 can be part of an inertial navigation system (INS) such as including one or more micro-electro-mechanical systems (MEMS). For example, INS 60 can include a MEMS angular rate sensor, such as a rate gyro, a MEMS accelerometer, and a magnetometer. Such INS systems are well known in the relevant art. Additionally or alternatively, in some embodiments, motion and angular position (including pitch, roll, and yaw) can be sensed by a differently configured INS 60, or by an attitude heading reference system (AHRS) that provides 3D orientation of vessel 10 by integrating gyroscopic measurements, accelerometer data, and magnetometer data. In some embodiments, INS 60 can receive orientation information from main IMU 36 and can also receive information from a GPS receiver 40 comprising part of a satellite-based radio navigation system (e.g., a global navigation satellite system (GNSS)), such as the global positioning system (GPS). GPS receiver 40 can be located at a pre-selected fixed position on vessel 10, which provides information related to a position of vessel 10 with respect to a planetary frame of reference (e.g., latitude, longitude, and height with respect to sea level). In some embodiments, main IMU 36 can also be located at a known and fixed position with respect to the center of rotation (COR) and/or center of gravity (COG) of vessel 10 (e.g., a COG when the vessel is empty).

In some embodiments, IMU data from each sensor IMU 62-68 and/or main IMU 36 can be provided to sensor processor 70 and/or to another controller (e.g., CCM 24, etc.). In some embodiments, as shown in FIG. 1, image data, depth data, and/or IMU data can be communicated to sensor processor 70 (and/or any other suitable controller), which can be via any suitable wired or wireless communication technique(s), such as via a dedicated communication bus, wireless transmission protocols (e.g. Bluetooth, Bluetooth Low Energy (BLE), ZigBee, ultra-wideband, etc.), a CAN bus comprising part of the vessel network, etc. Note that the dashed connection lines in FIG. 1 are meant to show only that the various control elements are capable of communicating with one another, and do not necessarily represent actual wiring connections between the control elements, nor do they represent the only paths of communication between the elements. In some embodiments, INS 60, one or more IMUs (e.g., IMUs 62-68), etc., can be omitted (e.g., where vessel 10 is not configured with a vision system, is not configured with relatively expensive sensors such as an INS, etc.).

In some embodiments, vessel 10 can include (and/or otherwise be associated with) one or more ambient condition sensors 38, which can be used to estimate and/or determine an environmental condition that may impact a course of vessel 10, such as wind speed, wind direction, current speed, current direction, etc. For example, ambient condition sensor(s) 38 can be implemented using a wind sensor configured to measure wind speed and/or wind direction (e.g., the speed and/or direction of the wind with respect to the sensor). In a more particular example, ambient condition sensor(s) 38 can include a mechanical wind sensor (e.g., a mechanical anemometer, such as a cup anemometer, or a vane anemometer) that measures the speed and/or direction of wind based on the impact of wind on one or more moving parts. As another more particular example, ambient condition sensor(s) 38 can include a non-mechanical wind sensor (e.g., an ultrasonic anemometer, a laser doppler anemometer, an acoustic resonance anemometer, etc.).

As another example, ambient condition sensor(s) 38 can be implemented using a water current sensor configured to measure water current speed and/or water current direction (e.g., the speed and/or direction of the water with respect to the sensor). In a more particular example, ambient condition sensor(s) 38 can include a mechanical water current sensor (e.g., a paddle wheel speed sensor) that measures the speed and/or direction of water based on the impact of water on one or more moving parts. As another more particular example, ambient condition sensor(s) 38 can include a non-mechanical water current sensor (e.g., an ultrasonic water speed sensor, an electromagnetic water speed sensor, etc.). In some embodiments, as shown in FIG. 1, data indicative of ambient conditions that may impact a course of vessel 10 (e.g., wind speed and/or direction, water current speed and/or direction) can be communicated between ambient condition sensor(s) 38 and controller 24, which can be via any suitable wired or wireless communication technique(s), such as via a dedicated communication bus, wireless transmission protocols (e.g. Bluetooth, BLE, ZigBee, UWB, etc.), a CAN bus comprising part of the vessel network, etc. In some embodiments, ambient condition sensor(s) 38 can be omitted (e.g., where ambient conditions are determined using image data captured by imaging device 72). Note that an accuracy of a direction of wind and/or water current can be impacted by movement of sensor(s) 38 as vessel 10 pitches, rolls, and/or yaws (e.g., due to ambient environmental conditions such as an impact of wind, water current, waves, etc., and/or due to propulsion by propulsion device 12*a*, 12*b*). In some embodiments, data indicative of motion of vessel 10 and/or sensor(s) 38 that may impact accurate determination of wind and/or water current detection can be used to adjust (e.g., correct) wind and/or water current data. Additionally or alternatively, in some embodiments, a wind sensor and/or water current sensor can be mounted to vessel 10 via a device that stabilizes a posture of the sensor, such as a mechanical or electromechanical gimbal device.

In some embodiments, some sensor processing functions can be performed by a separate computing device. For example, sensor processor 70 can communicate processed sensor data to controller 24, which can utilize the processed data for navigation functions and/or other vessel control functions. As described below, in some embodiments, sensor processor 70 can be associated with its own storage system comprising memory and its own processing system that executes programs and accesses data stored in the memory of sensor processor 70. Additionally or alternatively, in some embodiments, one or more functions described as being performed by sensor processor 70 can be incorporated in a multi-purpose controller, such as sensor processor software stored and executed within controller 24. For example, in some embodiments, controller 24 can control marine vessel navigation, such as path planning, autonomous point-to-point navigation, automatic docking, or other advanced operator assistance programs. In some embodiments, controller 24 can also perform one or more sensor processing functions. Additionally or alternatively, in some embodiments, functions described herein as comprising part of sensor processor functions can be distributed across two or more processing devices. For example, each imaging device 72-78 can include one or more processors that are configured to perform certain functions (e.g., performing object detection to classify one or more objects in the image, segmenting image data to classify one or more objects in the image, segmenting image data to identify portions of the image that correspond to a particular object or type of object, generating one or more bounding boxes, performing pose estimation of one or more objects in the image data, generating one or more RGBD images, generating one or more 3D depth maps, generating a point cloud corresponding to the 3D depth map, projecting points into a global coordinate system, etc.). As another example, each IMU 62-68 can include (or otherwise be associated with) one or more processors that are configured to perform calculations to interpret measured IMU data (such as to determine an attitude estimate for the respective IMU) and provide the interpreted IMU data to one or more other processing devices or controllers for execution of subsequent processing. In some embodiments, sensor processor 70 can be omitted (e.g., where sensor processing is performed by another controller, such as controller 24).

In some embodiments, a controller(s) (e.g., controller 24, sensor processor 70, etc.) can use any suitable information about the environment when planning a path for autonomous, semi-autonomous, or manual navigation. For example, as described below, the controller(s) can use environmental disturbance information that has been generated using sensor data from ambient condition sensor(s) 38, and/or using image data captured using an imaging device (e.g., imaging device 72). As another example, the controller(s) can use an occupancy grid that has been generated and/or updated using proximity information measured by proximity sensors (e.g., imaging devices 72-78 implemented using depth sensors, such as stereoscopic cameras). In some embodiments, the occupancy grid can be formatted as a data structure in which each element corresponds to a cell of the occupancy grid, and each element is indicative of a probability that the cell is occupied by an object/obstacle. In some embodiments, a controller(s) (e.g., controller 24, sensor processor 70, etc.) can use a current context to identify an maneuvering primitive that is appropriate for navigating to a target position in light of estimated environmental conditions. For example, as described below in connection with FIGS. 3A to 3E, 6, 8A to 8C, and 9, a particular set of maneuvers can be associated with a specific activity (e.g., trailering, docking, mooring, anchoring, etc.) and environmental conditions, and mechanisms described herein can identify appropriate instructions (e.g., a maneuvering primitive) that are appropriate in the current context from a set of instructions appropriate in different contexts (e.g., a set of maneuvering primitives, which can be organized and/or accessed using any suitable format and/or techniques, such as database techniques, knowledge base techniques, etc.).

In some embodiments, information indicating a probability of an object being located in a particular portion of image data and/or a model of the environment can be based on any suitable information. For example, image data (e.g., pixels) and/or location information (e.g., based on measurements by one or more of imaging devices 72-78) can be correlated with feature label information that identifies a classification of a feature. In some embodiments, the label information can be generated using any suitable technique or combination of techniques. For example, one or more images of an environment (e.g., color images) can be captured, and can be used to generate segmentation information (e.g., using a trained machine learning model), which can include classification information that indicates which of a set of classes different portions of the image are most likely to correspond. In some embodiments, the set of classes can include classes that are relatively likely for the vessel to encounter (e.g., in a marine environment). As another example, one or more images of an environment can be captured, and can be used to generate object detection information (e.g., using a trained machine learning model), which can include classification information that indicates which of a set of classes particular portions of the image are most likely to correspond (e.g., instances of a particular class of the set of classes). In some embodiments, classification information associated with objects in the environment can be associated with portions of a model used to represent the environment. For example, points in a point cloud can be assigned a label based on a classification of an object at that position. Additionally, in some embodiments, the classification information can include a confidence that the label is accurate (e.g., a probability of the portion of the image being an instance of the class corresponding to the label). In some embodiments, such a label can be used to determine a likelihood that a particular type of object is located at different points in the environment and/or image data.

In some embodiments, as vessel 10 traverses a path (e.g., a path planned by the controller(s), a current path set by an operator, etc.), the controller(s) can periodically (e.g., at regular and/or irregular intervals) project a model of vessel 10 forward along the path a predetermined distance to determine whether vessel 10 is likely to collide with any obstacles that may have obstructed the planned path (and/or that a sensor(s) may have detected the presence of) since the path was planned. For example, at a predetermined rate (e.g., once per second, twice per second, etc.), the controller(s) can determine whether a cell of the occupancy grid which vessel 10 (e.g., including a buffer area) is predicted to traverse is occupied. Additionally or alternatively, as vessel 10 traverses a path (e.g., a path planned by the controller(s), a current path set by an operator, etc.), the controller(s) can periodically project a model of vessel 10 along the path a predetermined distance (e.g., based on throttle and steering commands), and can compare the modeled position to a measured position (e.g., based on GPS measurements, IMU measurements, etc.) to estimate a contribution of environmental disturbances to the course of vessel 10.

In some embodiments, each processor (e.g., a processor of one or more of control modules 24, 26*a*, 26*b*) can access computer-readable code and, upon executing the code, carry out one or more functions, such as environmental impact estimation functions, mode and/or state determination functions, autonomous navigation functions, semi-autonomous navigation functions, object detection functions, image segmentation functions, environmental modeling functions, etc., as described in more detail below. In some embodiments, sensor processor 70 can be a dedicated, special-purpose computing system configured to process depth data and/or IMU data from depth sensors (e.g., imaging devices 72-78 implemented using depth sensors, such as stereoscopic cameras), sensor IMUs (e.g., IMUs 62-68, and/or main IMU 36), and/or generate image data (e.g., which can be used to perform object detection, image segmentation, mode and/or state determination, autonomous navigation, semi-autonomous navigation, etc.).

In some embodiments, mechanisms described herein can be configured to use information from one or more of imaging devices 72-78 to estimate an impact of ambient environmental conditions on a course and/or heading of vessel 10, and can use the estimated impact to plan an appropriate path to a storage structure, such as a trailer, dock, slip, etc. For example, as described below in connection with FIGS. 4-7, mechanisms described herein can use data generated by an imaging device of marine vessel 10 to determine motion of vessel 10 (sometimes referred to as ego motion) with respect to an object(s) in the environment (e.g., the storage structure). In such an example, mechanisms described herein can use any suitable technique to determine ego motion of vessel 10, such as optical flow techniques. As another example, mechanisms described herein can use data generated by an imaging device of marine vessel 10 to estimate motion of one or more other objects impacted by ambient environmental conditions, such as waves (e.g., impacted by wind direction and/or speed), floating objects impacted by wind speed and/or direction (e.g., wind can cause relatively light floating objects and/or objects with a relatively large surface area above the water to move along a surface of the water), and/or by water current speed and/or direction (e.g., current can cause heavier floating objects to move with the current).

In some embodiments, sensor processor 70 (and/or any other suitable processor(s)) can be programmed and/or otherwise configured to automatically determine an appropriate path to approach a storage structure, and/or appropriate maneuvers to approach the storage structure. For example, as described below in connection with FIGS. 3A to 3D and 4 to 6, sensor processor 70 (and/or any other suitable processor(s)) can plan an appropriate path to the storage structure, such as a path that mitigates difficulties navigating to a target location associated with the storage structure caused by ambient environmental conditions, and/or a path that mitigates risks (e.g., of injury and/or property damage) exacerbated by ambient environmental conditions. As another example, as described below in connection with FIGS. 3A, 3E, 4, 5, and 7, sensor processor 70 (and/or any other suitable processor(s)) can identify a set of appropriate angles from which to approach the storage structure, such as a set of approach angles that mitigate difficulties navigating to a target location associated with the storage structure caused by ambient environmental conditions, and/or a set of approach angles that mitigate risks (e.g., of injury and/or property damage) exacerbated by ambient environmental conditions. As yet another example, as described below in connection with FIGS. 4, 5, and 8A to 8C, sensor processor 70 (and/or any other suitable processor(s)) can identify appropriate maneuvers to approach a dock that mitigate difficulties and/or risks associated with docking that are caused by, and/or exacerbated by, ambient environmental conditions. As still another example, as described below in connection with FIGS. 4, 5, and 9, sensor processor 70 (and/or any other suitable processor(s)) can identify appropriate maneuvers to set anchor and/or moor at a mooring ball that mitigate difficulties and/or risks associated with mooring caused by, and/or exacerbated by, ambient environmental conditions.

Figure 2:
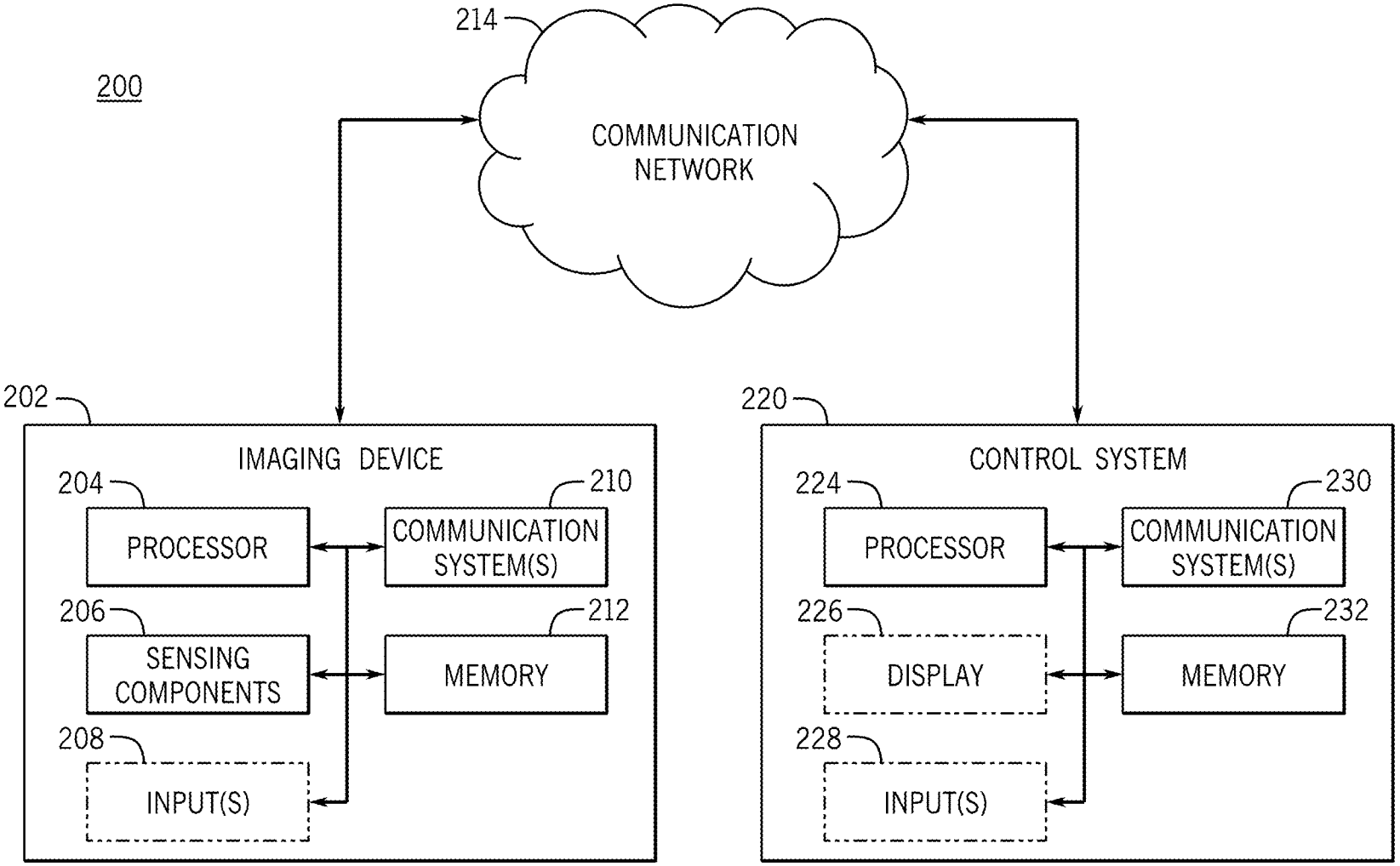
FIG. 2 shows an example of hardware that can be used to implement an imaging device and a control system in accordance with some embodiments of the disclosure.

FIG. 2 shows an example of hardware 200 that can be used to implement an imaging device 202, and a control system 220 in accordance with some embodiments of the disclosed subject matter.

As shown in FIG. 2, in some embodiments, sensor device 202 can include a processor 204, sensing components 206, one or more inputs 208, one or more communication systems 210, and/or memory 212. In some embodiments, processor 204 can be any suitable hardware processor or combination of processors, such as a central processing unit (CPU), an accelerated processing unit (APU), a graphics processing unit (GPU), a field programmable gate array (FPGA), an application specific integrated circuit (ASIC), etc.

In some embodiments, sensing components can include components that are used to capture image data of a scene (e.g., 2D visible light image data, 2D non-visible light image data, image data that includes depth, etc.) within a field of view of imaging device 202, and/or determine a three-dimensional location of an object and/or other feature of an environment (e.g., a water surface) that is within a field of view of imaging device 202. In some embodiments, imaging device 202 can include components used to implement one or more of imaging devices 72-78.

For example, imaging device 202 can be implemented as one or more cameras that include components that facilitate capture of 2D image data of a scene, such as a conventional digital camera (e.g., implemented using a CMOS or CCD image sensor). As another example, device 202 can be implemented as one or more cameras that include components that facilitate capture three-dimensional imaging of a region of an environment, such as a stereoscopic camera, a structured light camera, a continuous-wave time-of-flight camera, a direct time-of-flight camera, etc. As yet another example, imaging device 202 can be implemented as one or more lidar devices (e.g., a scanning lidar, a lidar including a 2D array sensor, etc.) that include components that facilitate three-dimensional characterization of a region of an environment. In such an example, a camera(s) (e.g., a two-dimensional camera) can be located to have an overlapping field of view with a lidar device (e.g., such a camera can be co-located), and can be used to capture images that can be used to classify portions of the environment (e.g., using a machine learning model trained to perform image segmentation). As still another example, imaging device 202 can be implemented as one or more sound-based devices (e.g., one or more sonar systems, such a side-scanning sonar system, etc.) that include components that facilitate three-dimensional characterization of a region of an environment. As a further example, imaging device 202 can be implemented as one or more radio wave-based devices (e.g., one or more radar systems, etc.) that include components that facilitate three-dimensional characterization of a region of an environment.

In some embodiments, inputs 208 can include any suitable input devices and/or sensors that can be used to receive user input, such as a keyboard, a mouse, a touchscreen, a touchpad, a microphone, a camera, etc. In some embodiments, imaging device 202 can omit inputs (e.g., where the imaging device is an embedded device, or where the imaging device is not configured for direct end user operation).

In some embodiments, communication system(s) 210 can include any suitable hardware, firmware, and/or software for communicating information over a communication network 214 and/or any other suitable communication networks. For example, communication system(s) 210 can include one or more transceivers, one or more communication chips and/or chip sets, etc., that can be used to establish a wired and/or wireless communication link. In a more particular example, communication system(s) 210 can include hardware, firmware, and/or software that can be used to establish a direct or indirect wired connection and/or a direct or indirect wireless connection, such as a CAN bus connection, a Bluetooth connection, Bluetooth Low Energy (BLE) connection, a ZigBee connection, a Wi-Fi connection, a cellular connection (e.g., an uplink connection, a downlink connection, or a sidelink connection), an ultra-wideband (UWB) connection, an Ethernet connection, etc.

In some embodiments, memory 212 can include any suitable storage device or devices that can be used to store instructions, values, etc., that can be used, for example, by processor 204 to generate image data based on output from sensing components 206, to generate depth information of a portion of the environment that characterizes the portion of the environment in three-dimensions, to identify and/or classify one or more objects and/or other features in a scene based on the depth information and/or image information, to communicate with control system 220 (e.g., sensor processor 70, CCM 24, and/or any other suitable control system) via communications system(s) 210, etc. Memory 212 can include any suitable volatile memory, non-volatile memory, storage, or any suitable combination thereof. For example, memory 212 can include random access memory (RAM), read-only memory (ROM), electronically erasable programmable read-only memory (EEPROM), one or more flash drives, one or more hard disks, one or more solid state drives, one or more optical drives, etc. In some embodiments, in addition to, or in lieu of, hardware, firmware, and/or software for communicating using radio waves, communication system(s) 210 can include one or more transmitters and/or receivers configured to communicate using one or more other communication modalities (e.g., sound-based communication, light-based communication, etc.), such as a transducer (e.g., for implementing sound-based communication), or a light sensor and/or light source (e.g., for implementing light-based communication).

In some embodiments, imaging device 202 can include any suitable display device(s) (not shown), such as a computer monitor, a touchscreen, a television, etc.

In some embodiments, memory 212 can have encoded thereon a computer program for controlling operation of imaging device 202. In such embodiments, processor 204 can execute at least a portion of the computer program to generate image data, to generate depth information, to identify and/or classify one or more objects and/or other features in a scene based on the image data and/or depth information, to transmit information to control system 230 (and/or any other suitable control system), to execute at least a portion of a process for maneuvering a marine vessel to a storage structure, such as processes described below in connection with FIGS. 4-7, etc.

In some embodiments, a control system 220 can include a processor 224, a display 226, one or more inputs 228, one or more communication system(s) 230, memory 232, and/or one or more output devices 234. In some embodiments, processor 224 can be any suitable hardware processor or combination of processors, such as a CPU, an APU, a GPU, an FPGA, an ASIC, etc. In some embodiments, display 226 can include any suitable display devices, such as a computer monitor, a touchscreen, a television, etc. In some embodiments, inputs 228 can include any suitable input devices and/or sensors that can be used to receive user input, such as a keyboard, a mouse, a touchscreen, a microphone, etc. In some embodiments, control system 220 can omit display 226 and/or inputs 228 (e.g., where control system 220 is an embedded device that is not configured for direct user interaction). For example, control system 220 can provide results of an analysis, image data, and/or a portion of a user interface to CCM 24, and CCM 24 can use the results, image data, and/or user interface to present a user interface, present image data, perform one or more autonomy functions, etc. In some embodiments, any suitable controller and/or control module (e.g., CCM 24, sensor processor 70, and/or any other suitable control system) can be used to implement control system 220.

In some embodiments, communication system(s) 230 can include any suitable hardware, firmware, and/or software for communicating information over a communication network 214 and/or any other suitable communication networks. For example, communication system(s) 230 can include one or more transmitters, one or more receivers, one or more transceivers, one or more communication chips and/or chip sets, etc., that can be used to establish a wired and/or wireless communication link. In a more particular example, communication system(s) 230 can include hardware, firmware, and/or software that can be used to establish a direct or indirect wired connection and/or a direct or indirect wireless connection, such as a CAN bus connection, a Bluetooth connection, a BLE connection, a ZigBee connection, a UWB connection, a Wi-Fi connection, a cellular connection (e.g., an uplink connection, a downlink connection, or a sidelink connection), an Ethernet connection, etc. In some embodiments, in addition to, or in lieu of, hardware, firmware, and/or software for communicating using radio waves, communication system(s) 230 can include one or more transmitters and/or receivers configured to communicate using one or more other communication modalities (e.g., sound-based communication, light-based communication, etc.), such as a transducer (e.g., for implementing sound-based communication), or a light sensor and light source (e.g., for implementing light-based communication).

In some embodiments, memory 232 can include any suitable storage device or devices that can be used to store instructions, values, etc., that can be used, for example, by processor 224 to analyze image data and/or depth information received from device 202 (and/or any other suitable imaging device), to identify and/or classify one or more objects and/or other features in a scene based on the image data and/or depth information, to communicate with imaging device 202 via communications system(s) 230, etc. Memory 232 can include any suitable volatile memory, non-volatile memory, storage, or any suitable combination thereof. For example, memory 232 can include RAM, ROM, EEPROM, one or more flash drives, one or more hard disks, one or more solid state drives, one or more optical drives, etc.

In some embodiments, memory 232 can have encoded thereon a computer program for controlling operation of control system 220. In such embodiments, processor 224 can determine that the marine vessel is being secured at a target position (e.g., on or in a storage structure, in position to be loaded onto or into a storage structure, by dropping anchor, etc.), estimate an impact of ambient environmental conditions on the heading and/or course of the marine vessel, determine an approach or approaches that account for the impact of ambient environmental conditions, and cause the marine vessel to maneuver to the target position using an identified approach, cause a graphical user interface to be presented to a user(s), receive information from imaging device 202, to execute at least a portion of a process for maneuvering a marine vessel to a storage structure, such as processes described below in connection with FIGS. 4-7, etc.

In some embodiments, communication network 214 can be any suitable communication network or combination of communication networks. For example, communication network 214 can include a Wi-Fi network (which can include one or more wireless routers, one or more switches, etc.), a peer-to-peer network (e.g., a Bluetooth network, a UWB network), a cellular network (e.g., a 3G network, a 4G network, a 5G network, etc., complying with any suitable standard(s), such as CDMA, GSM, LTE, LTE Advanced, 5G NR, etc.), a wired network, etc. In some embodiments, communication network 214 can include one or more portions of a control area network (CAN), a local area network (LAN), a wide area network (WAN), a public network (e.g., the Internet, which may be part of a WAN and/or LAN), any other suitable type of network, or any suitable combination of networks. Communications links shown in FIG. 2 can each be any suitable communications link or combination of communications links, such as wired links, fiber optic links, Wi-Fi links, Bluetooth links, UWB links, cellular links, etc.

Figure 3A:
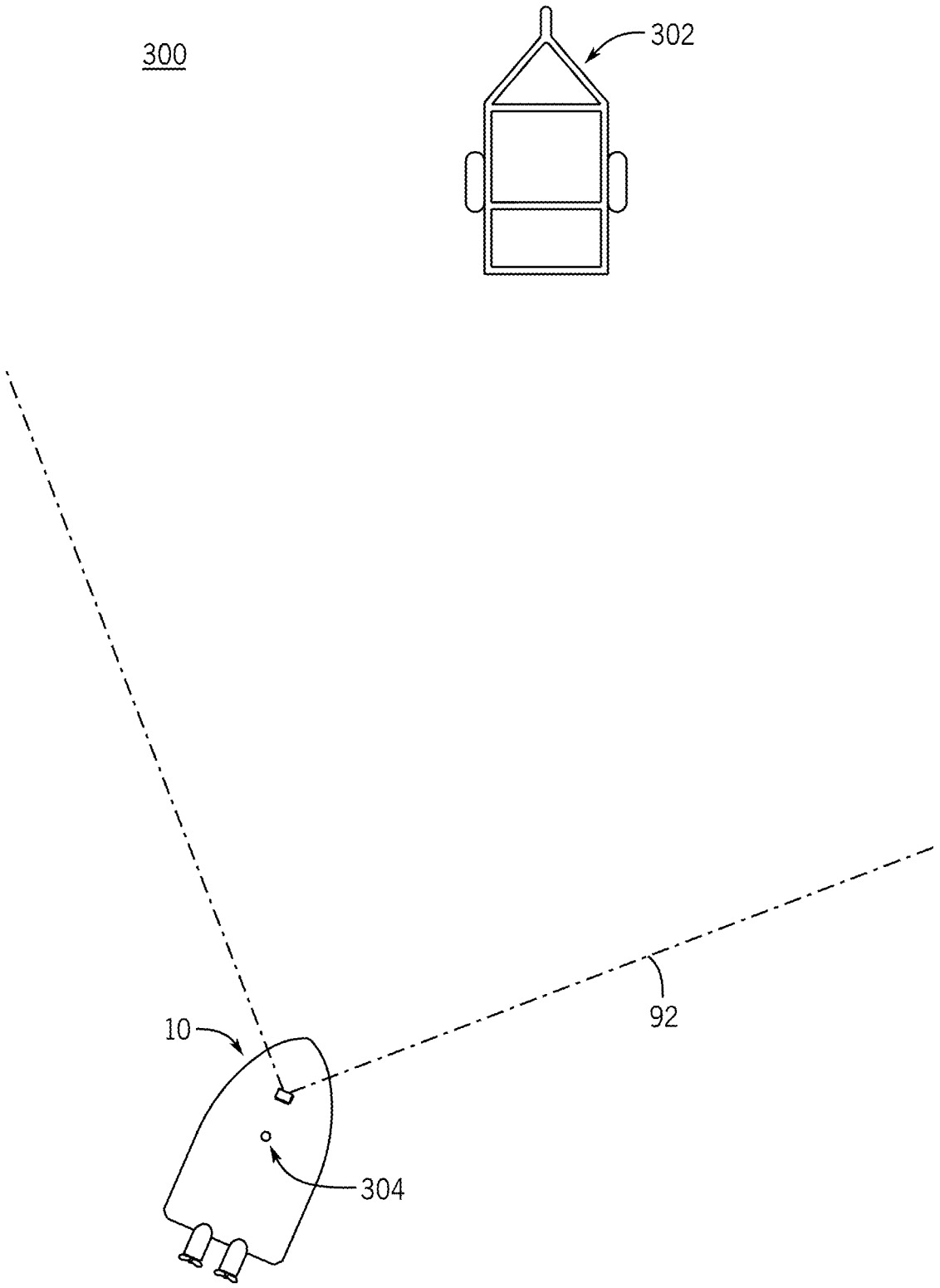
FIG. 3A shows an example of an environment in which a marine vessel can execute a process for maneuvering a marine vessel to a storage structure in accordance with some embodiments of the disclosed subject matter.

FIG. 3A shows an example of an environment 300 in which a marine vessel can execute a process for maneuvering a marine vessel to a storage structure in accordance with some embodiments of the disclosed subject matter. In some embodiments, vessel 10 (e.g., via control system 220) can analyze environment 300 to estimate an impact that wind and/or water current is likely to have on vessel 10 as it is maneuvered toward a storage structure 302 (or other type marine vessel storage structure) to be stored and/or otherwise secured. In the example of FIG. 3A, storage structure 302 is a boat trailer, and vessel 10 is being loaded onto trailer 302 (which is sometimes referred to herein as trailering). Note that although FIG. 3A is described in connection with trailering vessel 10 on a trailer, mechanisms described herein can be used in connection with: loading vessel 10 on, or in, any suitable storage structure (e.g., a boat lift, a boat house, a slip, etc.); docking vessel 10 at any suitable storage structure such as a dock or other structure; mooring at a mooring ball; dropping anchor; etc.).

As described below, vessel 10 can be loaded onto trailer 302 manually (e.g., by an operator controlling propulsion using one or more input devices of operation console 22), autonomously (e.g., by an autonomy system controlling a propulsion device(s) of vessel 10), and/or semi-autonomously. In some embodiments, vessel 10 can estimate an impact of wind and/or water current on the heading and/or course of vessel 10, and can determine an appropriate path, angle(s) of approach, and/or maneuvers that facilitates safely and efficiently navigating to a target position at which vessel 10 is to be stored and/or secured.

In the example shown in FIG. 3A, vessel 10 can capture image data including at least a portion of environment 300 that includes an object(s) (such as at least a portion of trailer 302) that can be used to estimate how ambient environmental conditions are likely to impact vessel 10. For example, as described below in connection with process 500 of FIG. 5, a sequence of images can be captured while vessel 10 is drifting, and the image data can be analyzed (e.g., using optical flow techniques) to determine movement of vessel 10 while drifting, which can be attributed to the ambient environmental conditions. As another example, a sequence of images can be captured of an object that moves under the influence of wind and/or current (e.g., a wave(s), a floating object(s)), and the image data can be analyzed (e.g., using optical flow techniques) to determine movement of the object(s), which can be attributed to the ambient environmental conditions. In some embodiments, an estimated impact of wind and/or water current on vessel 10 can be modeled as a linear force acting on a particular point of vessel, such as point 304. In some embodiments, point 304 can be a COG or COR of vessel 10 (e.g., if wind and/or current is expected to cause translation of vessel 10 with little to no rotation). Alternatively, in some embodiments, an estimated impact of wind and/or water current on vessel 10 can be modeled as one or more linear forces acting on a particular point(s) of vessel and/or one or more rotational forces (e.g., if wind and/or current is expected to cause significant rotation of vessel 10). Note that vessel 10 can use other sources of information to estimate how ambient environmental conditions are likely to impact vessel 10, such as information from ambient condition sensor(s) 38, IMU 36, etc.

Figure 3B:
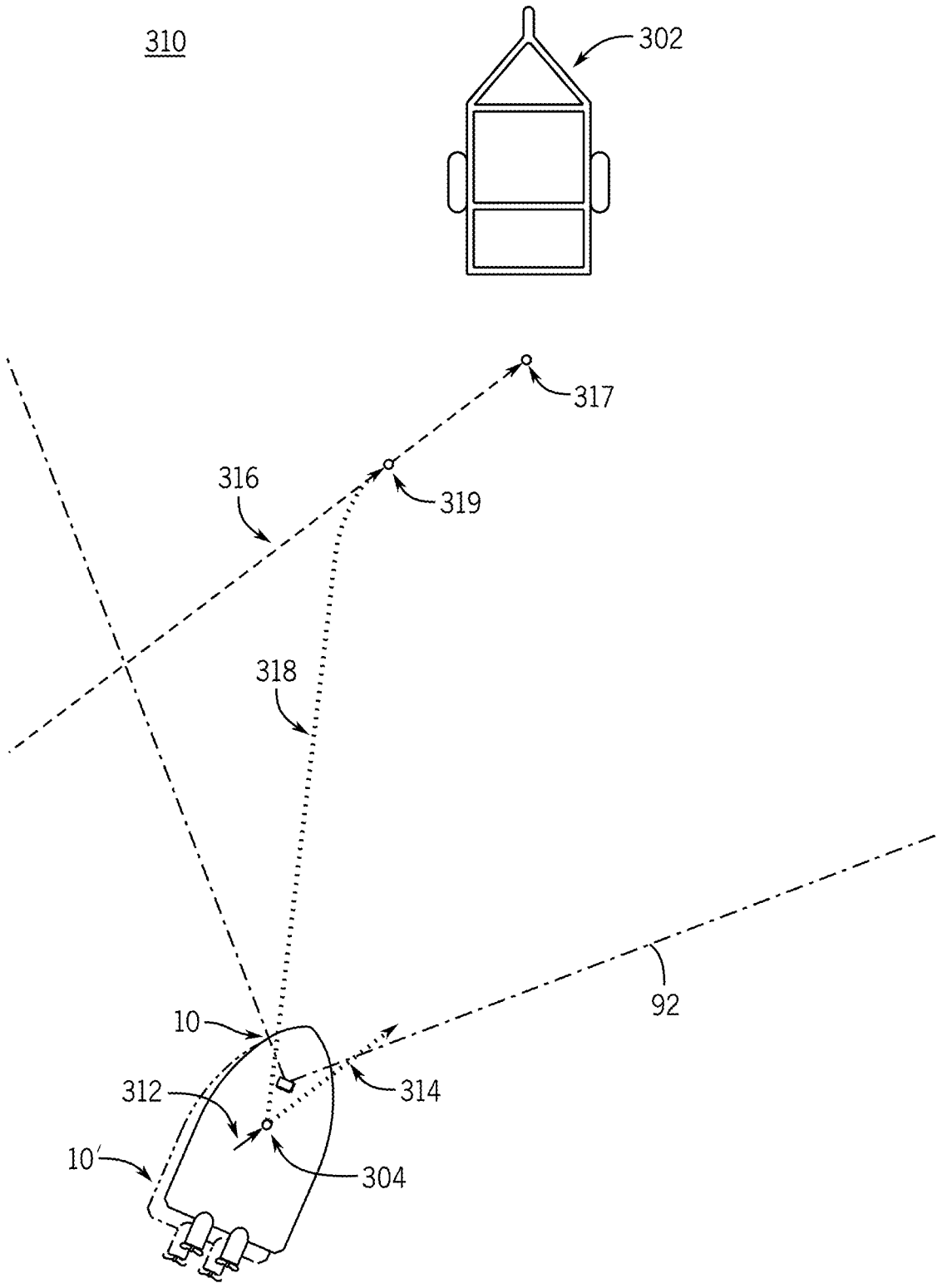
FIG. 3B shows an example in which the marine vessel has estimated an environmental disturbance on a course of the marine vessel to the storage structure and determined a path to a target location based on the environmental disturbance in accordance with some embodiments of the disclosed subject matter.
Figure 3C:
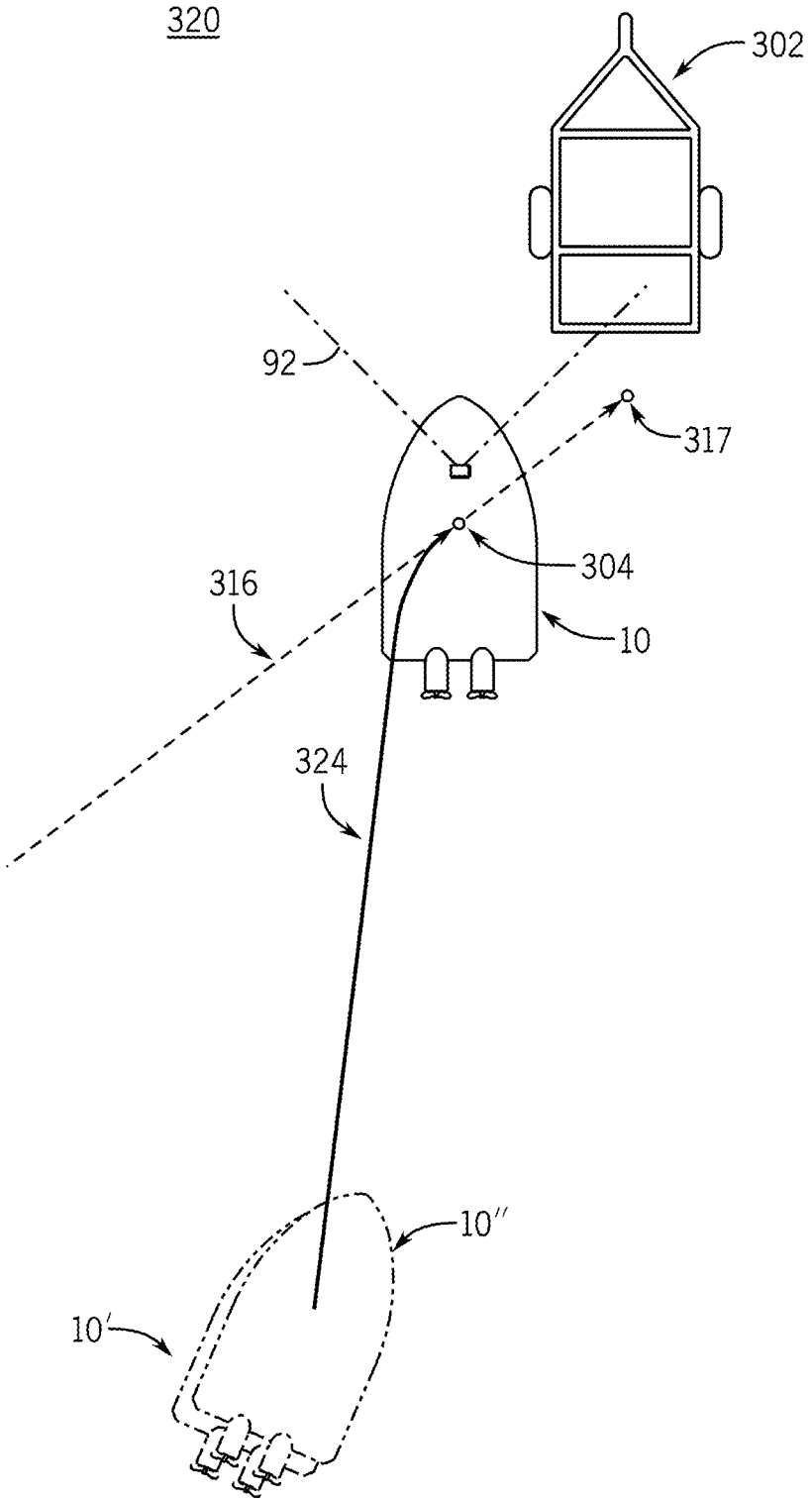
FIG. 3C shows an example in which the marine vessel has maneuvered toward the target location based on the path in accordance with some embodiments of the disclosed subject matter.
Figure 3D:
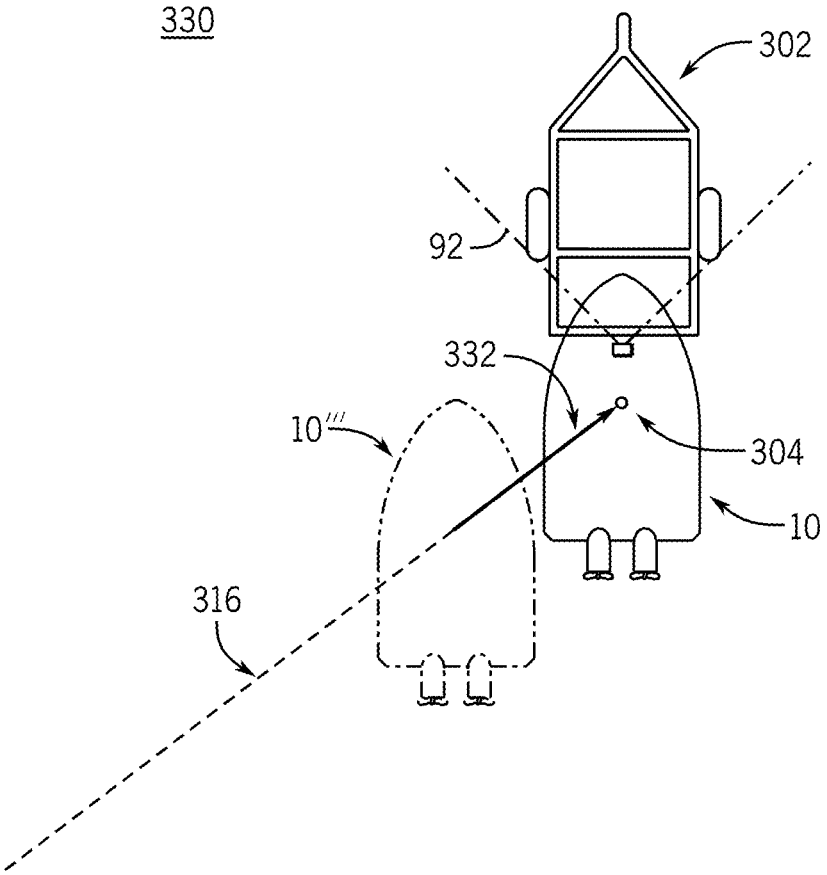
FIG. 3D shows an example in which the marine vessel has arrived at the target location and is positioned to efficiently maneuver to a secured position with respect to the storage structure in accordance with some embodiments of the disclosed subject matter.
Figure 3D:
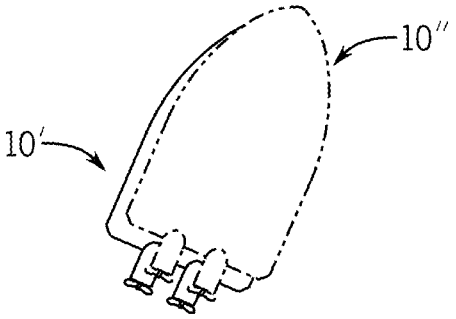

FIGS. 3B to 3D show examples in which the marine vessel estimated an environmental disturbance, determined a path to a target location, maneuvered toward the target location based on the path, and arrived at the target location positioned to efficiently maneuver to a secured position with respect to the storage structure in accordance with some embodiments of the disclosed subject matter. In FIG. 3B, example 310 shows vessel 10 in a different position, and shows an outline 10', showing an original position of vessel 10 in the example of FIG. 3A. Vector 312 shows movement (e.g., in two dimensions) during a predetermined period of time in which movements of vessel 10 can be confidently attributed to environmental conditions (e.g., rather than a combination of environmental conditions and thrust from propulsion devices 12*a*, 12*b*). For example, an autonomy system of vessel 10 can cause vessel 10 to drift for a predetermined period of time. As another example, a controller of vessel 10 can prompt a user to allow vessel 10 to drift (e.g., by setting an input to control propulsor speed to neutral/idle, and/or stopped). In some embodiments, estimated environmental impact 314 can be represented as a vector (e.g., in a plane that represents a surface of water in environment 300, such as the x/y plane shown in FIG. 1). Such a vector can be a unit vector that represents a direction of the estimated environmental impact, or a vector that represents the direction of the estimated environmental impact, and the magnitude (e.g., in any suitable units, such as meters/second (m/s), kilometers per hour (kph), feet per second (ft/s), miles per hour (mph), etc.) of the estimated environmental impact. In some embodiments, estimated environmental impact 314 can be used to estimate a disturbance force on the marine vessel (e.g., marine vessel 10) based on the angle of attack of the marine vessel with respect to estimated environmental impact 314 (e.g., by incorporating estimated environmental impact 314 into an estimate of drag), which can be used to determine the environmental impact for various different orientations of the marine vessel.

In some embodiments, for example as described below in connection with process 500 of FIG. 5, mechanisms described herein can estimate an environmental impact 314 on the heading and/or course of vessel 10 based on the motion of vessel 10 while drifting and under the influence of ambient environmental conditions (e.g., due to one or more environmental influences, such as wind and/or water current). In some embodiments, mechanisms described herein can identify a path of movement 316, based on estimated environmental impact 314, of vessel 10 due to ambient environmental conditions near a target position 317. Target position 317 can be a location at which vessel 10 can be successfully loaded onto trailer 302 (e.g., using only straightforward commands, such as forward thrust, if vessel 10 is being manually operated, and/or using safe and efficient maneuvers, if vessel 10 is being manually, semi-autonomously, or autonomously operated).

In the example of FIG. 3B, path of movement 316 is angled toward trailer 302, and vessel 10 (e.g., using controller 24, sensor process 70, etc.) can identify a path 318 that facilitates loading of vessel 10 onto trailer 302 when vessel 10 reaches target position 317. For example, following path 318, an operator (or an autonomy system) can be instructed to begin drifting near a point 319, and allow ambient environmental conditions to move vessel 10 from point 319 to target position 317 in neutral. A different location for point 319 can be selected as an end of a planned path if vessel 10 is to approach target location 317 under thrust (e.g., at a forward idle thrust lever position, a backward idle thrust lever position if estimated environmental impact 314 is likely to cause vessel 10 to approach trailer 302 at a speed above a maximum speed, even if drifting.

As another example (not shown in FIGS. 3A to 3E), path of movement 316 can be angled away from trailer 302 (e.g., ambient environmental conditions can be expected to cause a drifting vessel 10 to move away from trailer 302). In such an example, vessel 10 (e.g., using controller 24, sensor process 70, etc.) can identify a path that facilitates loading of vessel 10 onto trailer 302 when vessel 10 reaches target position 317, while under thrust (e.g., at a forward idle thrust lever position, or a position corresponding to greater thrust). In a particular example, the planned path can be a path that an operator (or an autonomy system) can follow under a particular magnitude of thrust to arrive at a point (e.g., corresponding to point 319 in FIG. 3A) at which thrust is to be adjusted, and allow vessel 10 to arrive at target position 317 at a speed and orientation that is consistent with safely and efficiently loading vessel 10 onto trailer 302. In such an example, the path can be similar to the path shown in FIGS. 3A to 3D, while the approach orientation of the vessel can be angled into the line of movement (e.g., at a relatively steep angle, up to 90 degrees from the centerline of the trailer) until the vessel has reached a position at which it can be turned to align with the trailer, as the wind/current impacting the vessel can be expected to push the bow into alignment with the trailer. Additionally, in such an example, an angle of approach can be aimed forward of the centerline of the trailer, as steering the bow with the wind to align with the trailer can be more desirable (e.g., more predictable, more efficient, etc.).

In FIG. 3C, example 320 shows vessel 10 in yet another position, and shows an outline 10" showing the position of vessel 10 in example 310, and outline 10' showing original position of vessel 10 in the example of FIG. 3A. As shown in FIG. 3C, vessel 10 moved along a course 324, such that point 304 is approximately collocated with point 319. In the example shown in FIG. 3C, an operator (or an autonomy system of vessel 10) can reduce or eliminate thrust being provided by propulsion devices 12*a*, 12*b*, as ambient environmental conditions can be expected to move vessel 10 into position to be loaded onto trailer 302.

In FIG. 3D, example 330 shows vessel 10 in a position from which vessel 10 can be loaded onto trailer 302, and shows an outline 10" showing the position of vessel 10 in example 320, and outlines 10" and 10' showing previous positions of vessel 10. As shown in FIG. 3C, vessel 10 moved along a course 332, such that point 304 is approximately collocated with target position 317.

Figure 3E:
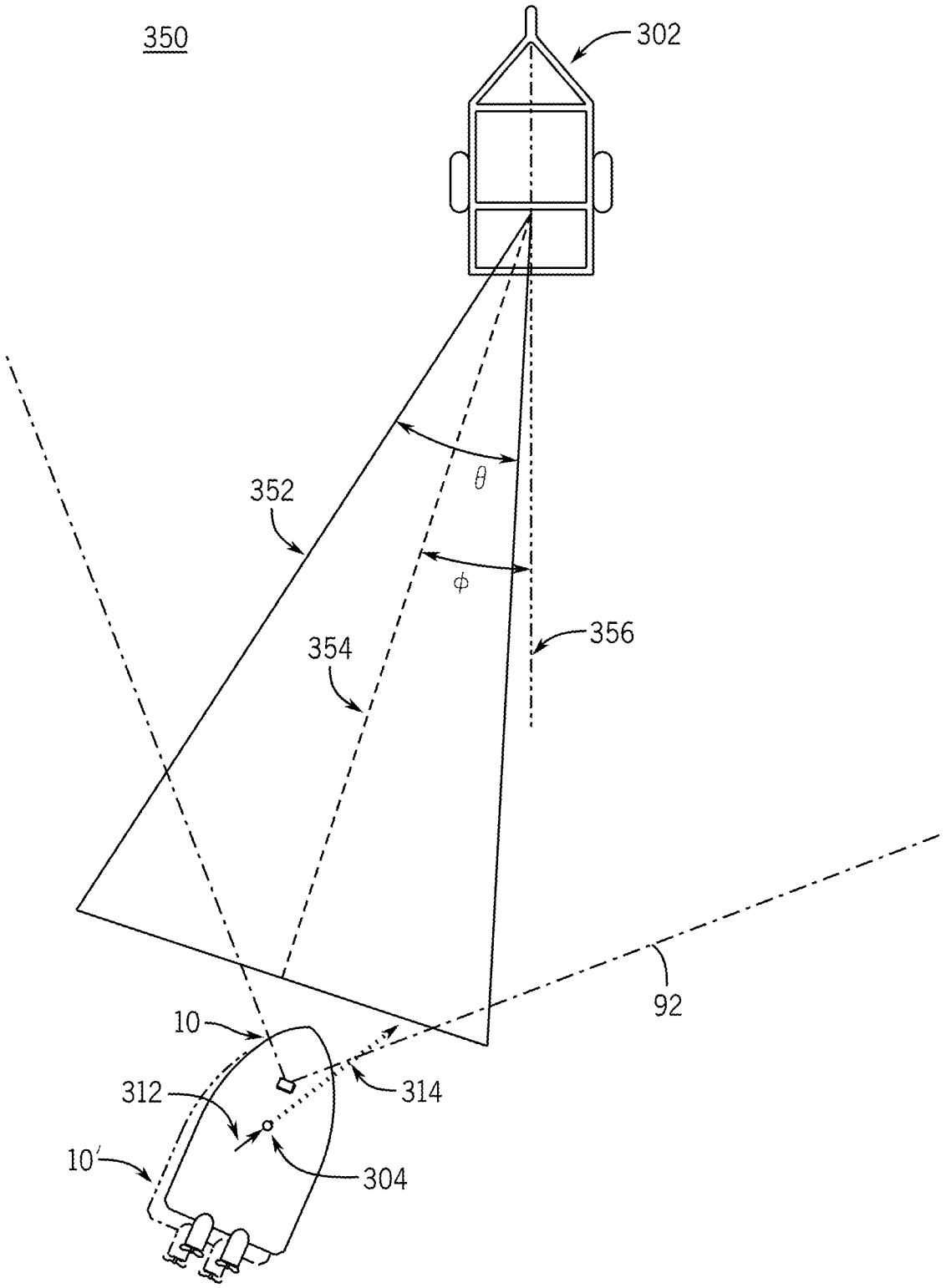
FIG. 3E shows an example in which the marine vessel has estimated an environmental disturbance on a course of the marine vessel to the storage structure and determined a set of viable paths to the storage structure based on the environmental disturbance in accordance with some embodiments of the disclosed subject matter.

FIG. 3E shows an example in which the marine vessel has estimated an environmental disturbance on a course of the marine vessel to the storage structure and determined a set of viable paths to the storage structure based on the environmental disturbance in accordance with some embodiments of the disclosed subject matter. In FIG. 3E, example 350 shows vessel 10 in a different position, and shows outline 10', showing an original position of vessel 10 in the example of FIG. 3A. As in the example of FIG. 3B, vector 312 shows movement (e.g., in two dimensions) during a predetermined period of time in which movements of vessel 10 can be confidently attributed to environmental conditions (e.g., rather than a combination of environmental conditions and thrust from propulsion devices 12*a*, 12*b*), and environmental impact 314 on the heading and/or course of vessel 10 is also shown. In some embodiments, mechanisms described herein can identify a cone 352 representing angles of approach to trailer 302 from which vessel 10 is expected to be able to safely approach and be successfully loaded onto trailer 302 (e.g., using only straightforward commands, such as forward thrust, if vessel 10 is being manually operated, and/or using safe and efficient maneuvers, if vessel 10 is being manually, semi-autonomously, or autonomously operated).

In the example of FIG. 3E, cone 352 can be modeled with a vertex at a point of the storage structure (e.g., trailer 302) at which the centerline of the trailer intersects a perpendicular line at which the centerline of the vessel is expected to be substantially aligned with the centerline of the trailer (e.g., a point at which misalignment is likely to make it difficult to load the vessel onto the trailer. For example, for a trailer or other storage structure with raised guides (e.g., guide-on posts, bunk-style guide-ons, structural posts, etc.) the vertex can be located at a point at which a line between rear-most points of the raised guides intersects the centerline. As another example, for a trailer or other storage structure without raised guides, the vertex can be located at a point near which the centerline intersects the water (e.g., at the point, a predetermined distance rearward of that point, etc.). In some embodiments, mechanisms described herein can determine an angle of deflection $\phi$ from which a centerline 354 of cone 352 is deflected from a centerline 356 of trailer 302 based on environmental impact 314. For example, environmental impact 314 is angled toward trailer 302 and to a starboard side of trailer 302. In the example, mechanisms described herein can determine that an angle of deflection $\phi$ in the ±yaw direction, as this can improve the safety of vessel 10 approaching trailer 302 and can improve the likelihood that vessel 10 can be successfully loaded onto trailer 302.

Additionally, in some embodiments, mechanisms described herein can determine a size of cone 352 based on one or more characteristics of the storage structure (e.g., a width of trailer 302, a distance between bunks of trailer 302, etc.), one or more characteristics of vessel 10 (e.g., a beam of vessel 10, a hull shape of vessel 10, a draft of vessel 10, etc.), environmental impact 314, and/or any other suitable factor, and can determine an angle $\theta$ that can be used to determine a shape of cone 352. For example, a narrow opening of trailer 302 can restrict the viable angles from which trailer 302 can be approached, and a smaller angle $\theta$ can be appropriate for such a storage structure. As another example, under stronger ambient environmental conditions, approaching from a wider angle (e.g., further from centerline 356) may be associated with safety risks and/or a reduced likelihood that vessel 10 can be successfully loaded onto trailer 302, a smaller angle $\theta$ can be appropriate for such conditions. In some embodiments, angle $\theta$ can be based on speed. For example, angle $\theta$ can decrease as approach speed increases. In a particular example, an upper limit can be set (or assumed) on approach speed, and angle $\theta$ can be determined based on the upper limit.

Figure 4:
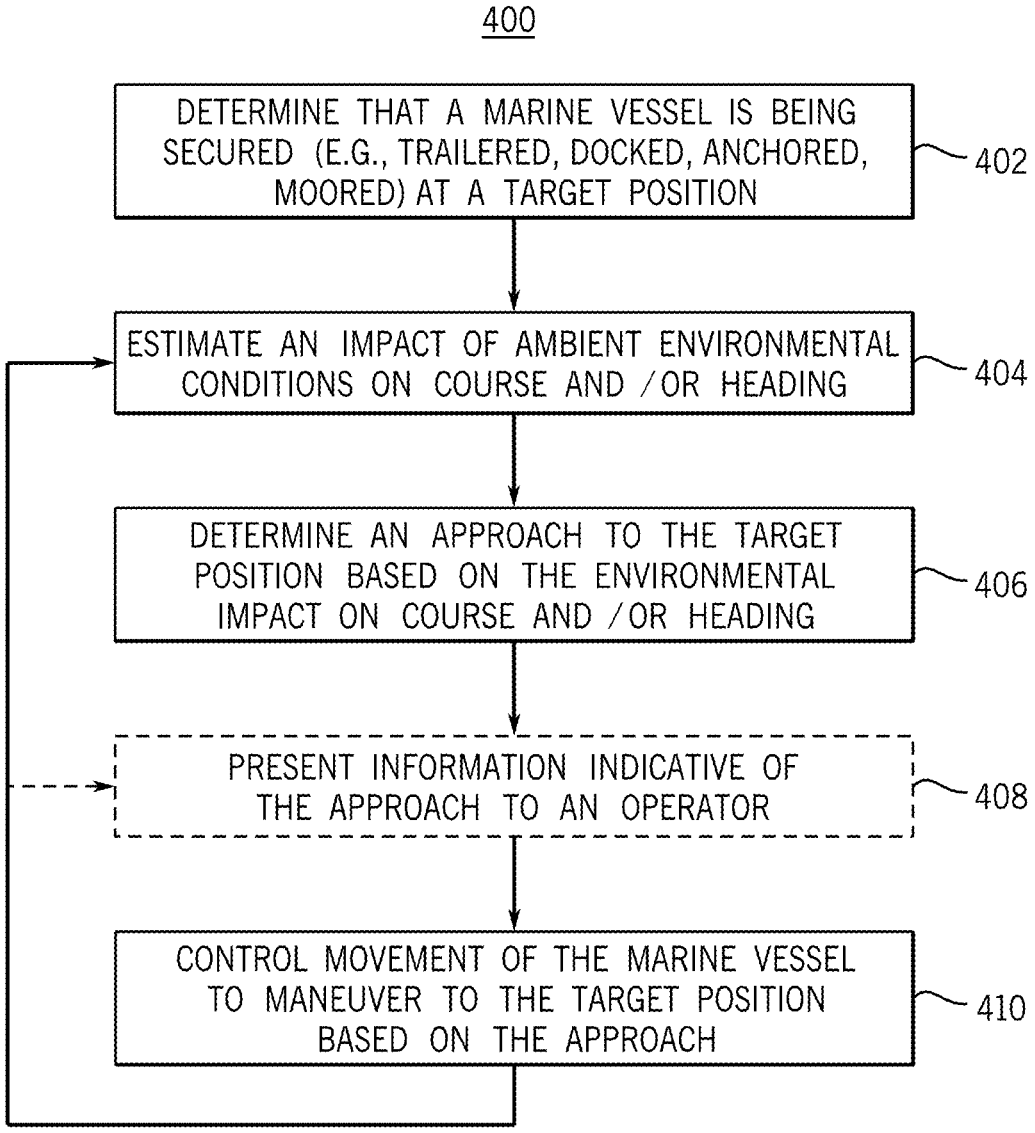
FIG. 4 shows an example of a process for maneuvering a marine vessel to a storage structure in accordance with some embodiments of the disclosed subject matter.

FIG. 4 shows an example of a process 400 for maneuvering a marine vessel to a storage structure in accordance with some embodiments of the disclosed subject matter.

At 402, process 400 can determine that the vessel is being secured at a target position associated with a storage structure (e.g., a trailer, a dock, a slip, a boat lift, a boat house, a mooring ball, etc.) and/or storage location (e.g., a berth, a mooring ball, a position at which to drop anchor, etc.). In some embodiments, process 400 can determine that the marine vessel is being secured using any suitable technique or combination of techniques. For example, process 400 can determine that the marine vessel is being secured based on input received via an input device (e.g., input 228) indicative of selection of a particular mode (e.g., a trailering mode, a docking mode, a mooring mode, an anchoring mode, etc.), such as selection of a selectable user interface element presented using a graphical user interface (e.g., on MFD 29), selection of a key of keypad 28, and/or using any other suitable input device. As another example, process 400 can determine that the marine vessel is being secured based on content of an image captured by an imaging device (e.g., the image data including a storage structure at which the vessel is to be secured). In a more particular example, process 400 can determine that the marine vessel is being trailered based on a trailer being present in the FOV of a particular imaging device for at least a predetermined amount of time (e.g., 15 seconds, 30 second, 1 minute, 5 minutes, etc.). In such an example, process 400 can prompt an operator to confirm that the marine vessel is being trailered (e.g., via a graphical user interface). In some embodiments, a user can provide input indicating how the vessel is secured (e.g., on a trailer, on a boat lift, to a mooring ball, to a dock, via an anchor, etc.). Note that although process 400 is generally described below in connection with loading a marine vessel on a trailer (sometimes referred to herein as trailering), mechanisms described herein can be used in connection with any suitable storage structure for a marine vessel, such as a boat lift, a boat house, a slip, etc.

A vessel can be secured using a variety of techniques, and can be secured in various ways. For example, a vessel can be secured if the vessel is loaded on a trailer (e.g., the vessel can be trailered). As another a vessel can be secured if the vessel is secured to a dock or mooring ball (e.g., the vessel can be docked or moored). As yet another example, a vessel can be secured if an anchor of the vessel has been deployed (e.g., the vessel can be anchored). As still another example, a vessel can be secured if the vessel is beached. As a further example, a vessel can be secured if it is tied up to any suitable structure.

In some embodiments, a target position can be any suitable location associated with the storage structure and/or storage location. For example, the target position can be a position that is on or in a storage structure. As another example, the target position can be a position from which the vessel can be loaded onto or into a storage structure. As yet another example, the target position can be a position from which the vessel can be secured to the storage structure (e.g., moored to a mooring ball, tied up to a dock, etc.). As yet another example, the target position can be a position at which the vessel can safely drop anchor.

In some embodiments, a target position can be a location at which the marine vessel can be successfully secured, stored, and/or loaded. For example, the target position can be a position from which the marine vessel can be secured and/or stored using relatively straightforward maneuvers. In a more particular example, a target position with respect to a trailer can be a position from which an operator can load the marine vessel onto the trailer using relatively simple commands, such as commanding forward thrust with that is generally aligned with a longitudinal axis of the marine vessel.

At 404, process 400 can estimate an impact of ambient environmental conditions on the course and/or heading of the vessel. In some embodiments, process 400 can use any suitable technique or combination of techniques to estimate the impact of ambient environmental conditions. For example, process 400 can estimate motion of the marine vessel when the marine vessel is not under being actively propelled (e.g., without zero thrust output by propulsion devices 12*a*, 12*b*). In a more particular example, process 400 can use techniques described below in connection with process 500 of FIG. 5 to estimate motion of the marine vessel based on motion of one or more fixed objects in the environment (e.g., using optical flow techniques, and/or any other suitable computer vision techniques). As another more particular example, process 400 can use one or more sensors (e.g., a GPS receiver, an IMU, an INS, etc.) to estimate motion of the marine vessel. As another example, process 400 can estimate motion of one or more objects in the environment that are likely to be moved by ambient environmental conditions, such as a floating object(s) and/or waves, (e.g., using optical flow techniques, and/or any other suitable computer vision techniques). As yet another example, process 400 can estimate the impact of ambient environmental conditions using one or more ambient condition sensors (e.g., ambient condition sensor(s) 38). As still another example, process 400 can compare an expected position and/or orientation at a particular time (e.g., based on a previously measured position and commands issued to a propulsion device(s) of the vessel, such as throttle and steering commands) to a measured position and/or orientation at the particular time (e.g., based on GPS measurements, IMU measurements, INS measurements, etc.). In such an example, a difference between the predicted position/orientation and the measured position/orientation can be indicative of a contribution of ambient environmental conditions. In some embodiments, process 400 can prompt an operator to confirm whether the estimated impact is reasonably accurate. For example, process 400 can cause one or more user interface elements to be presented (e.g., via a graphical user interface) that indicates (e.g., via a graphic (s), text, audio, etc.) a direction and/or magnitude of the estimated impact. In such an example, process 400 can prompt an operator to indicate whether the estimate seems reasonable via input to one or more selectable user interface elements (e.g., presented via a touchscreen, or physical soft key), or other input devices, such as buttons 28.

At 406, process 400 can determine an approach or set of approaches to the target position based on the estimated environmental impact on course and/or heading. In some embodiments, process 400 can plan a path to the target position (e.g., using one or more path planning techniques) that uses safe, efficient, and relatively simple maneuvers, and that accounts for the contribution of the estimated environmental impact on the vessel. For example, process 400 can use techniques described above in connection with FIGS. 3A to 3D to identify a path for approaching the target position. As another example, process 400 can use techniques described below in connection with process 600 of FIG. 6 to identify a path for approaching the target position.

In some embodiments, process 400 can identify a set of approaches (e.g., angles or approach, speed, etc.) that are likely to facilitate a safe and efficient approach to the target position. For example, process 400 can use techniques described above in connection with FIGS. 3A and 3E to identify a set of viable paths and/or angles for approaching the target position. As another example, process 400 can use techniques described above in connection below in connection with process 700 of FIG. 7 to identify a set of viable paths and/or angles for approaching the target position. As yet another example, process 400 can use techniques described below in connection with FIGS. 8A and 8C to identify an approach to use to maneuver to the target position. As still another example, process 400 can use techniques described below in connection with FIG. 9 to identify an angle(s) from which to maneuver to the target position.

At 408, process 400 can cause information indicative of the identified approach (or set of approaches) to an operator. For example, process 400 can present a user interface that includes an illustration of the estimated identified approach or approaches on a representation of the environment and/or storage structure. In a more particular example, a user interface element (e.g., a line, a cone, etc.) representing the identified approach (or set of approaches) can be overlaid on a live image that includes the target position and/or storage structure (e.g., captured by imaging device 72). In such an example, a user interface element (e.g., a line, a cone, etc.) representing the heading of the marine vessel can also be overlaid on the live image, which can provide visual feedback that facilitates alignment of the marine vessel with an identified approach by an operator. As another example, a user interface element (e.g., a line, a cone, etc.) representing the identified approach(es) can be overlaid on a model of the environment (e.g., a representation of an occupancy grid, a chart or map representing a position and orientation of the marine vessel and the environment, etc.). As another example, process 400 can present a user interface that includes information indicative of an identified approach (es), such as information identifying a direction from which to approach the target position (e.g., a compass heading, as described below in connection with FIG. 9), or an angle at which to approach the target position (e.g., a shallow angle or a steep angle, as described below in connection with FIGS. 8A to 8C, which can be indicated using text, an infographic, an animation, etc.).

In some embodiments, 408 can be omitted (e.g., where the approach is used by the autonomy system without operator intervention).

At 410, process 400 can include controlling movements of the marine vessel to maneuver to the target position based on the identified approach (or set of approaches). In some embodiments, process 400 can facilitate control by an operator (e.g., via information presented at 408). For example, process 400 can present (and update in real-time) a graphical user interface that includes a user interface element illustrating a relationship between the identified approach(es) and the marine vessel, which can visually guide an operator while controlling the vessel.

Additionally or alternatively, in some embodiments, process 400 can provide information indicative of the approach(es) determined at 406 to an autonomy system, which can determine a set of marine vessel maneuvers that safely and efficiently move the marine vessel to the target position based on a constraint(s) consistent with the approach(es). For example, the autonomy system can use the path determined at 406 to propel the marine vessel to target position. As another example, the autonomy system can use a set of viable angles determined at 406 (e.g., a cone, as described above in connection with FIG. 3E) as a constraint (s) in planning a path to the target position.

In such examples, the autonomy system can determine marine vessel movements that can cause the marine vessel to reach the target position, and control a propulsion system of the marine vessel (e.g., propulsion system 20) that actuates a marine propulsion device(s) (e.g., propulsion device 12*a* and/or 12*b*) to propel the marine vessel to the target position without operator intervention. Note that the autonomy system can automatically control thrust produced by propulsion system 20, which can vary in magnitude and/or direction along a path to the target position in order to counteract and/or take advantage of the estimated environmental conditions.

Figure 5:
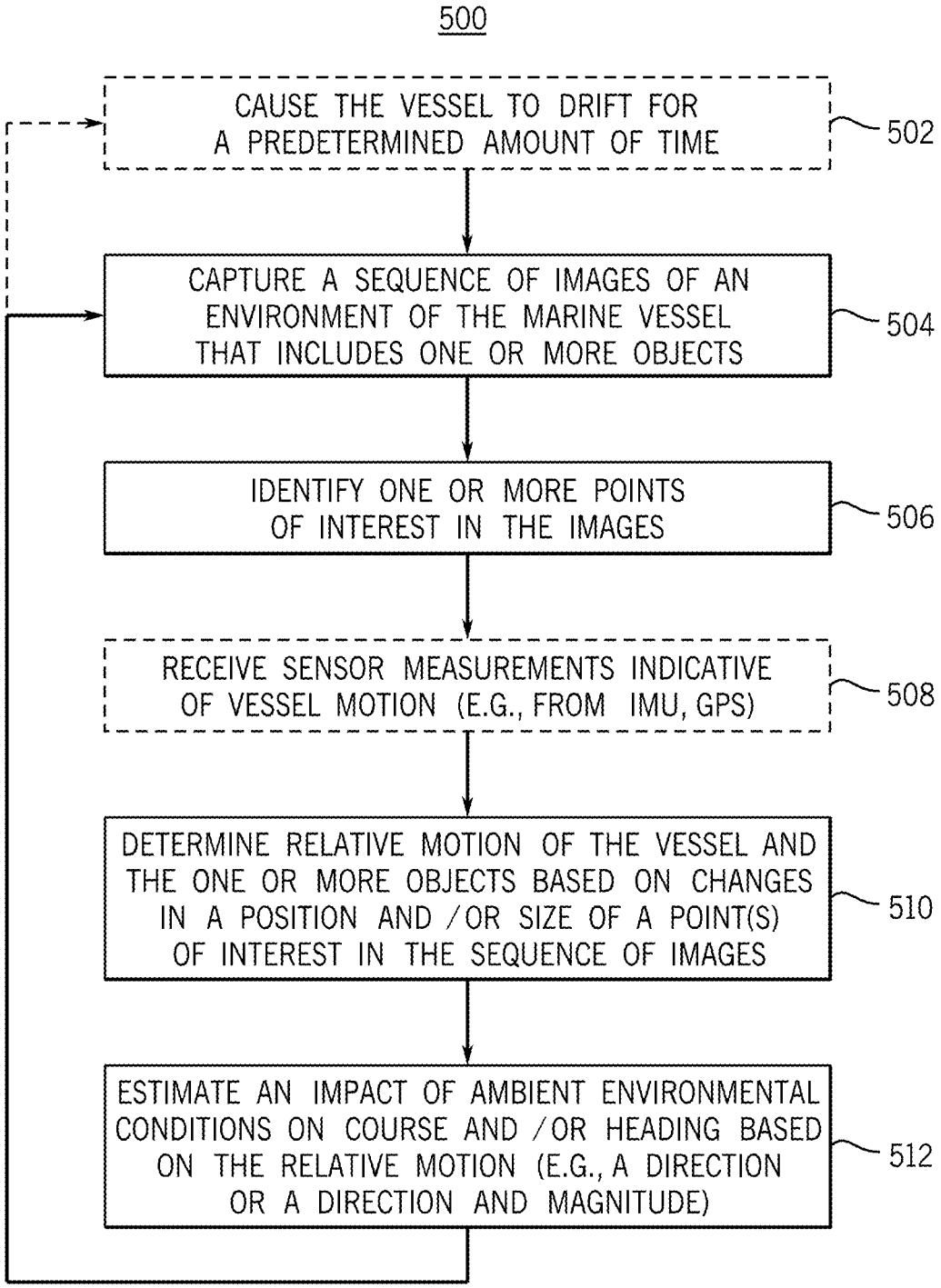
FIG. 5 shows an example of a process for estimating an environmental disturbance on a course of the marine vessel in accordance with some embodiments of the disclosed subject matter.

FIG. 5 shows an example of a process 500 for estimating an environmental disturbance on a course of the marine vessel in accordance with some embodiments of the disclosed subject matter.

At 502, process 500 can cause the marine vessel to drift for a predetermined period of time. In some embodiments, process 500 can prompt an operator of the marine vessel to cause the marine vessel to drift (e.g., without any thrust provided by a propulsion device, such as propulsion devices 12*a*, 12*b*) for a predetermined time (e.g., at least 5 seconds, 10 seconds, 30 seconds, etc.). For example, in response to determining that the marine vessel is being secured at a target location (e.g., as described above in connection with 402 of FIG. 4), such as a boat trailer, process 500 can prompt an operator to cause the marine vessel to drift (e.g., via a graphical user interface, via a sound, etc.), and can indicate an amount of time that the vessel is to be allowed to drift (e.g., via information indicating the minimum time, a timer indicating when the predetermined time has elapsed, information indicating that the operator can resume operating the vessel, etc.). As another example, in response to determining that the marine vessel is being secured at a target location (e.g., as described above in connection with 402 of FIG. 4), such as a boat trailer, process 500 can instruct an autonomy system to cause the marine vessel to drift for a predetermined amount of time. In some embodiments, the amount of time can be based on an amount of time associated with a process used to determine movements of the vessel while those movements can be confidently attributed to environmental conditions. Additionally, in some embodiments, the amount of time can be based on an amount of time for the marine vessel to begin drifting (e.g., when thrust previously provided by a propulsion device has a minimal influence on movements of the marine vessel). For example, such an amount of time can be based on the initial speed of the vessel, the hull shape, etc.

In some embodiments, 502 can be omitted (e.g., where the impact of ambient environmental conditions is estimated using a technique that does not require the vessel to drift).

At 504, process 500 can receive a sequence of image data, depth data, and/or any other suitable data that of an environment of the marine vessel that includes one or more objects (e.g., an object(s) that can be used to determine motion of the object relative to the marine vessel during a predetermined period of time). In some embodiments, process 500 can receive the image data, depth data, and/or other suitable data from any suitable source (e.g., one or more cameras, memory associated with one or more cameras, memory associated with a controller and/or sensor processor, etc.), and/or can cause the image data, depth data, and/or other suitable data to be captured or otherwise generated. For example, process 500 can cause a camera(s) to capture a sequence of images of an environment of the marine vessel that includes one or more objects. In some embodiments, process 500 can capture a sequence of images of an environment of the marine vessel using any suitable imaging device, such as imaging device 72, and/or one or more of imaging devices 72-78. Note that although process 500 is generally described in connection with digital image data, other types of data that can be used to determine relative motion of an object in the environment, such as lidar data, sonar data, radar data, etc.

In some embodiments, the one or more objects can include relatively static objects in the environment, such as a trailer, a dock, a towing vehicle, a tree, etc., and/or a relatively dynamic objects in the environment, such as objects floating on a surface of the water, waves, etc.

In some embodiments, the image data and/or depth data received and/or captured at 504 can be image data and/or depth data captured for an explicit purpose other than determining motion of one or more objects in the environment. For example, images can be captured to perform machine vision processes (e.g., to facilitate autonomous navigation, obstacle avoidance, etc.). Accordingly, process 500 can leverage image data, depth data, and/or other suitable data, captured for another purpose and can utilize the data to estimate the impact of ambient environmental conditions based on motion of an object(s) relative to the marine vessel.

At 506, process 500 can identify one or more points of interest in the images. In some embodiments, process 500 can use any suitable technique or combination of techniques to identify points of interest associated with an object(s) in the environment. For example, process 500 can use a corner finding, edge finding, and/or blob detection technique to identify potential points of interest from 2D image data, a depth map, and/or point cloud data associated with an object(s). In a more particular example, process 500 can identify points of interest from 2D image data using techniques such as: the Harris corner detector; Scale Invariant Feature Transform (SIFT); Speeded Up Robust Feature (SURF); Features from Accelerated Segment Test (FAST); Oriented FAST and Rotated BRIEF (ORB). In another more particular example, process 500 can identify points of interest from 3D data (e.g., RGBD data, point cloud data); such as the 3D Harris operator which can be used to detect corners in the point cloud data; ThrIFT (a 3D extension based on SIFT); NARF, 3D-SIFT, etc.

In some embodiments, process 500 can identify points of interest in a portion of the image data corresponding to an object(s) that can be used to estimate an environmental disturbance on a course and/or heading of the marine vessel caused by ambient environmental conditions. For example, portions of the image data captured at 504 can be classified (e.g., using image segmentation, object detection, etc.), and classification information can be used to identify a portion of the image that is likely to correspond to a suitable object. In such an example, process 500 can identify points of interest in only the portions of the image data that are likely to correspond to a suitable object. As another example, process 500 can identify points of interest in, and can filter the points of interest based on which are within a portion of the image data that is likely to correspond to a suitable object (e.g., based on classification of the image data) to remove points of interest corresponding to objects that are likely to be unsuitable.

Additionally or alternatively, in some embodiments, process 500 can identify one or more waves and/or one or more wave characteristics (e.g., wave height, direction, wavelength, etc.) based on the image data, depth data, and/or other suitable data using any suitable technique or combination of techniques. In some embodiments, process 500 can analyze image data (e.g., 2D or 3D image data generated by an imaging device, such as one or more of imaging devices 72-78) to identify waves using any suitable technique or combination of techniques. For example, in some embodiments, process 500 can use one or more trained machine learning models that have been trained to identify waves based on images of water, and/or to identify water in an image. In such an example, the machine learning model can be trained using any suitable data such as 2D or 3D image data that includes water having waves, with information identifying different portions of the images (e.g., labels, such as a segmentation mask, bounding boxes, etc.) that correspond to different parts of the waves, such as a trough, a crest, a face of the wave, a tube, whitecaps, whitewater, a shoulder, curl, etc. In such an example, a label associated with points in the image data (e.g., pixels) can indicate which points are likely to be water and/or a water surface of a body of water, and accordingly may include a wave. Such information can be used to filter out data from the image data that is unlikely to include waves (e.g., solid objects, land, etc.), and an analysis at 506 can be performed on only points that are likely to be water and/or a water surface of a body of water. As another example, techniques such as histogram of oriented gradients (HOG) and graph cut optimization can be used to identify portions of waves in image data. As yet another example, techniques utilizing a Kalman filter can be used to estimate when a wave will collide with an object (e.g., the vessel) using video or a series of still images captured over time.

In some embodiments, information about movement of the vessel (e.g., based on IMU data, based on changes in an orientation of the horizon or other fixed objects in image data, etc.) can be used to estimate a location of a common plane (e.g., a plane of the water surface under calm conditions, a plane at an average height of the water), and wave location can be associated with the common plane. Movement of the vessel and the cameras on the vessel over time can cause apparent movement of waves in a global coordinate system associated with the vessel that is due to a combination of movements of the vessel (e.g., roll, pitch, translation, etc.) and movement of the waves over the surface of the water. Information about movements of the vessel can be used to adjust apparent motion of the waves to account for independent motion of the vessel, and movement of the waves can be more reliably tracked over time.

As another example, in some embodiments, process 500 can determine a height of water at one or more particular distances (e.g., from a particular image sensor, from vessel, etc.) over time, and can generate a profile of the water height at each particular distance (e.g., a 1D profile of height over time). In such an example, process 500 can analyze a predetermined portion of the profile to identify waves represented in the profile based on the heights in the profile (e.g., one minima and one maxima in the profile can represent a wave that passed the particular distance). In such an example, additional information about the wave can be determined, such as a wavelength, a period, a velocity, a height, etc. In some embodiments, process 500 can use a line fitting technique to fit a curve to the profile (e.g., a sinusoid), and can determine properties of the waves based on properties of the fitted curve.

As yet another example, in some embodiments, process 500 can identify waves in a slice of depth data (e.g., from point cloud data, depth map data, etc.). In such an example, process 500 can generate a profile of water height at a particular moment in time (e.g., by sampling the depth data along a particular line or strip in the depth data generated at a particular point in time), which can be, for example, a 1D profile of height from one distance from the vessel and/or depth sensor to another distance from the vessel and/or depth sensor (e.g., an axial distance from a particular depth sensor, a radial distance from a particular portion of the marine vessel), or a particular length within an environment (e.g., a line parallel to a long axis of the vessel, a line parallel to a short axis of the vessel, a line at an oblique angle to a long axis and/or short axis of the vessel, etc.). In such an example, process 500 can analyze the profile to identify waves represented in the profile based on the heights in the profile (e.g., one minima and one maxima in the profile can represent a wave at a particular location along the line being analyzed). In such an example, depth data within a patch of depth data can be aggregated into a slice of depth data (e.g., a 1D slice) by averaging height information across one dimension (e.g., a lateral dimension). In some embodiments, process 500 can use a curve fitting technique to fit a line to the profile (e.g., a sinusoid), and can determine properties of the waves based on properties of the fitted curve. In some embodiments, different slices that correspond to various headings can be analyzed, and a slice that results in a largest wave amplitude and/or a shortest wavelength can be used to determine wave heights, as a slice that falls closest to a heading of the waves can be expected to have a shortest wavelength. In some embodiments, if multiple prevailing wave directions are present with amplitude exceeding the threshold, process 500 can estimate ambient environmental conditions based on which is more likely to be caused by local ambient environmental conditions (e.g., wind), and/or an estimate of a likelihood that each prevailing wave direction is caused by local ambient environmental conditions.

At 508, process 500 can receive sensor measurements indicative of vessel motion. For example, process 500 can receive IMU data and/or INS data indicative of a change in posture of the vessel over time along one or more axes (e.g., corresponding to translational acceleration) and/or about one or more axes (e.g., corresponding to rotation). As another example, process 500 can receive GPS data indicative of a change in location of the vessel over time along one or more axes (e.g., corresponding to movement in one or more directions). In some embodiments, 508 can be omitted (e.g., where movements of the vessel are estimated using static objects in the environment while the vessel is allowed to drift).

At 510, process 500 can determine relative motion of the marine vessel and the one or more objects based on changes in a position and/or size of a point(s) or interest in the sequence of images. In some embodiments, process 500 can use optical flow techniques to determine movement of an object (e.g., in a camera coordinate system) in the environment over time along one or more axes. For example, if a point of interest moves within the image plane, it can correspond to lateral movement with respect to the camera coordinate system, which can correspond to a horizontal and/or vertical movement in a frame of reference based on the marine vessel (e.g., a global coordinate system or the marine vessel). As another example, if a point of interest changes in apparent size within the image plane, it can correspond to axial movement with respect to the camera coordinate system (e.g., toward or away from the camera), which can correspond to horizontal movement in a frame of reference based on the marine vessel.

In some embodiments, if process 500 is determining movement of the marine vessel based on motion of static objects (e.g., while the marine vessel is drifting), optical flow information about an object(s) in the environment can be used to determine movement of the marine vessel during a particular period of time (e.g., while the marine vessel was drifting) based on the movement of the object(s) during that period of time, as the motion can be expected to be due to movement of the vessel (and corresponding movement of the camera mounted to the vessel). For example, if process 500 determines that one or more static objects have moved by a particular amount during a particular period of time (e.g., which can be represented as a vector in the global coordinate system), process 500 can estimate the motion of the vessel as being the inverse of the object motion (e.g., if the object moved in the +x direction, the movement can be attributed to movement of the camera in the −x direction). Multiple vectors can be used to determine a direction of movement of the marine (e.g., in a plane roughly corresponding to the water surface), and/or rotation about one or more axes of rotation (e.g., pitch, roll, and/or yaw).

Additionally or alternatively, if process 500 is determining motion of one or more dynamic objects (e.g., while the marine vessel is drifting or being actively controlled), optical flow information about an object(s) in the environment can be used to estimate an impact of environmental conditions on that object, which can be used to estimate an impact of the environmental conditions on the marine vessel. For example, movement of an object floating on a surface of the water (e.g., an object with a relatively large surface area above the water) can generally be attributed to an impact of wind on the object. As another example, movement of an object floating mostly below a surface of the water (e.g., an object with a relatively large surface area under the water) can be attributed to an impact of water current and/or wind on the object. In such examples, if the marine vessel and the object are both moving (e.g., within a geographic coordinate system), motion of the vessel (e.g., based on data from one or more sensors receiver at 508, and/or movement of the vessel determined based on optical flow of static objects at 510) can be used to estimate motion of the object(s) in the geographic coordinate system, and that motion can be used to estimate ambient environmental conditions (e.g., a direction of an environmental disturbance caused by the ambient environmental conditions, or a direction and magnitude of an environmental disturbance caused by the ambient environmental conditions).

At 512, process 500 can estimate an impact of ambient environmental conditions on course and/or heading based on the relative motion of the object(s). For example, if motion of the marine vessel was determined at 510, process 500 can estimate the impact of ambient environmental conditions directly based on the motion of the marine vessel. As another example, if motion of one or more moving objects was determined at 510, process 500 can estimate the ambient environmental conditions based on movement of the object(s) (e.g., a direction such as a wind and/or water current direction; or a magnitude and direction such as wind speed and direction, and/or a water current speed and direction), and can model an impact on the marine vessel of the ambient environmental conditions. In a more particular example, if wind and/or water current is causing a floating object to move in a particular direction, process 500 can determine that the wind and/or water current is likely to cause the marine vessel to move in the same direction. Additionally, in such an example, if the marine vessel is not aligned with the direction of movement, process 500 can determine that the wind and/or water current is likely to impact a heading of the marine vessel over time (e.g., due to a differential impact of the ambient conditions on different portions of the vessel). As another more particular example, if wind and/or water current is causing a floating object to move at a particular speed, process 500 can estimate the speed at which the wind and/or water current is likely to cause the marine vessel to move (e.g., based on the different shape and mass of the marine vessel), as the same environmental disturbance is likely to impact a lighter object more than a heavier object, and is likely to impact an object with a larger surface area to mass ratio than an object with a lower surface area to mass ratio (e.g., wind is likely to cause a floating plastic bottle to move more quickly than the marine vessel). In some embodiments, process 500 can estimate ambient environmental conditions based on non-movement data, such as a direction, size, and/or other characteristics of waves (e.g., which can be based on an alignment of waves in the environment, in addition to, or in lieu of, an explicit estimation of movements of a particular point of the wave, such as a crest or trough, over time).

In some embodiments, process 500 can return to 502 and/or 504 to continue generate data that can be used to estimate an impact of ambient environmental conditions (e.g., to determine when such conditions change).

Figure 6:
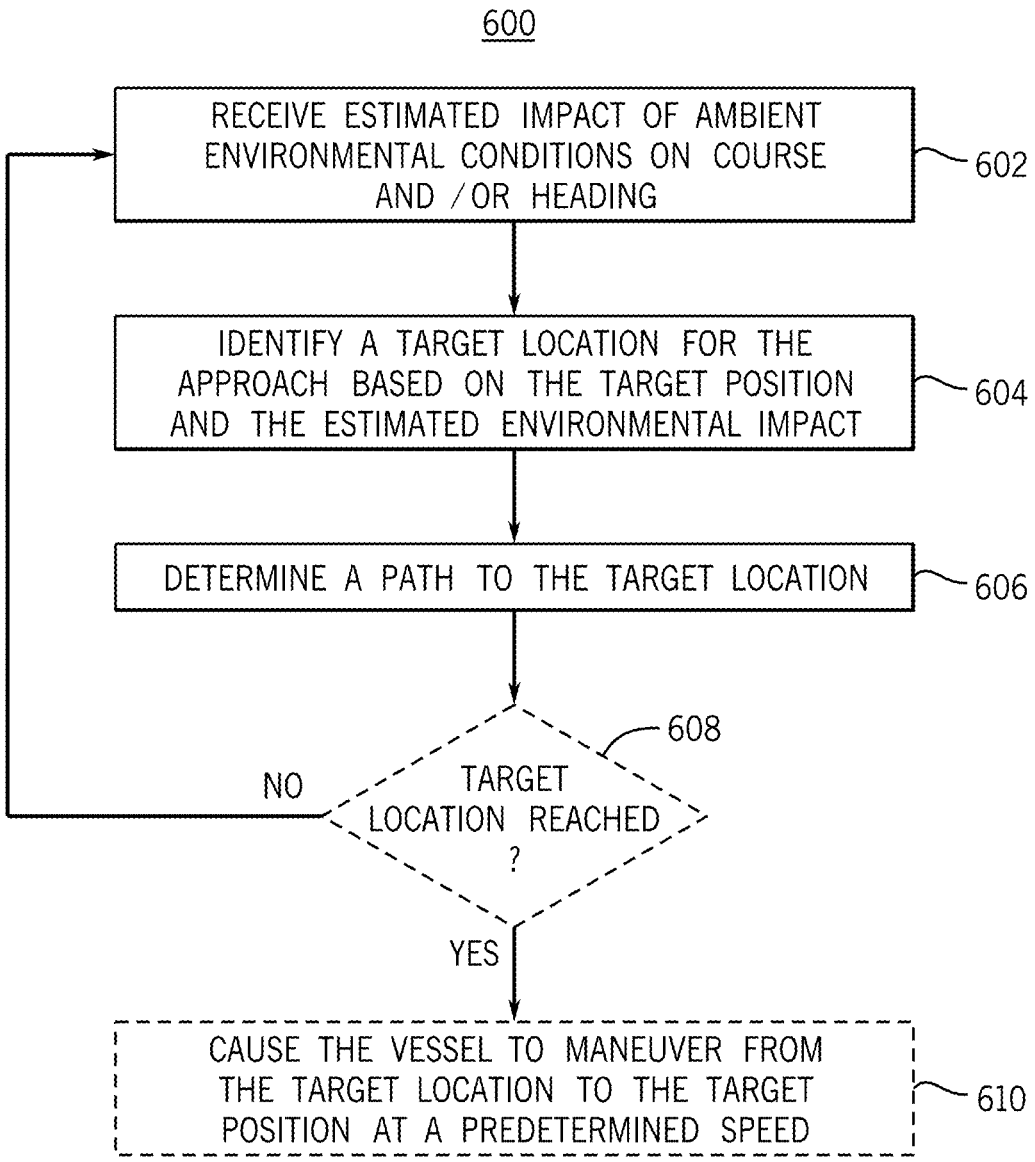
FIG. 6 shows an example of a process for determining a path to a target location based on an estimated environmental disturbance on a course of the marine vessel in accordance with some embodiments of the disclosed subject matter.

FIG. 6 shows an example of a process 600 for determining a path to a target location based on an estimated environmental disturbance on a course of the marine vessel in accordance with some embodiments of the disclosed subject matter.

At 602, process 600 can receive an estimated impact of ambient environmental conditions on the course and/or heading of the marine vessel. In some embodiments, the estimated impact can be received from any suitable source, and/or can be determined using any suitable technique or combination of techniques. For example, the estimated impact of ambient environmental conditions can be an estimated impact calculated at 404. As described above in connection with process 400 of FIG. 4, process 600 can prompt an operator to confirm whether the estimated impact is reasonably accurate (e.g., by presenting user interface that shows and/or explains a direction and/or magnitude of the estimated impact, and prompts the operator to indicate whether the estimate seems reasonable via input to one or more selectable user interface elements, or other input device).

At 604, process 600 can identify a target location for the approach based on the target position and the estimated environmental impact. In some embodiments, process 600 can identify the target location using any suitable technique or combination of techniques. For example, in some embodiments, process 600 can identify a target location based on a direction and/or magnitude of the estimated impact received at 602 and a target position. In such an example, the target location can be location at which a position and heading of the marine vessel facilitate movement to the target position with relatively simple maneuvers (e.g., drifting, forward idle speed with a centered propulsor, reverse idle speed with a centered propulsor, relatively simple joystick maneuvers, etc.). In some embodiments, the target location and the target position can be co-located.

In some embodiments, process 600 can identify an appropriate maneuvering primitive from a set of maneuvering primitives based on the direction (or direction and magnitude) of the estimated impact of ambient environmental conditions, and a context (e.g., trailering, docking, etc.). For example, for wind/current directed toward a trailer at an angle, process 600 can identify a maneuvering primitive that includes instructions appropriate to the environmental conditions and context (e.g., that includes instructions to "position the boat at a location up-current, oriented parallel to the trailer, then allow the boat to drift a certain distance before softly accelerating onto the trailer"). In such an example, process 600 can use the maneuvering primitive to identify the target location and/or target position.

At 606, process 600 can determine a path to the target location using any suitable technique or combination of techniques. For example, in some embodiments, process 600 can identify a path that is safe (e.g., does not intersect, or closely approach, any obstructions), that is relatively efficient (e.g., uses relatively few changes in thrust and/or steering, uses relatively little energy, aligns a heading of the vessel with a heading needed to store the vessel when the target location and/or target position are reached, etc.) and/or that can be effectively executed (e.g., by an operator of the vessel, by an autonomy system of the vessel, etc.). In such an example, the path can be based on the estimated ambient environmental conditions, and the impact that conditions are likely to have on the vessel. In a particular example, if the estimated ambient environmental conditions are pushing the vessel toward the storage location, process 600 can identify a path that places the vessel in position to drift to the target position. As another more particular example, if the estimated ambient environmental conditions are pushing the vessel away from the storage location, process 600 can identify a path that approaches the target location and/or target position at a relatively steep angle into the direction of the environmental disturbance.

In some embodiments, if an operator is to drive the marine vessel along the path, process 600 can identify a path that is safe, relatively efficient, relatively simple, and that has relatively large margins for error (e.g., does not require precise timing, and/or precise tracking of the path). For example, when planning a path for an operator, simplicity and safety can be prioritized over efficiency. Additionally or alternatively, in some embodiments, if an autonomy system to drive the marine vessel along the path, process 600 can identify a path that is safe and efficient, which may require more precise and/or more complex maneuvers than maneuvers that would be selected if an operator is controlling the vessel. For example, when planning a path for an autonomy system, safety and efficiency can be prioritized over simplicity.

In some embodiments, process 600 can use any suitable technique or techniques to plan a path for navigation between a current location of vessel 10 and a target location (e.g., a particular position near a trailer, a slip, a dock, etc.). For example, a controller(s) executing process 600 can calculate a path using a relatively simple model of vessel 10 (e.g., modeling vessel 10 as a circle having a diameter equal to a dimension of vessel 10, such as a longest dimension, which can be based on an assumption that vessel 10 can move laterally or a width, which can be based on an assumption that vessel 10 can be expected to move predominantly in forward and reverse direction). In such an example, the dimension used can be a dimension including a buffer distance around vessel 10. As another example, the controller(s) can calculate a path using a more complex model of vessel 10 (e.g., modeling vessel 10 as having dimensions of a buffer area, evaluating a swept area of the boat during maneuvers, etc.). Additionally, the controller(s) can plan a path based on the cost (e.g., in terms of energy expended) of particular maneuvers to be performed by vessel 10. In some embodiments, the controller(s) can calculate a path using one or more constraints. For example, the controller(s) can calculate a path that takes into account the estimated environmental disturbance, that avoids colliding with any objects, and that has an acceptable cost within a time budget allotted to reach the target location. In some embodiments, process 600 can use a suitable maneuvering primitive identified at 604 in path planning. For example, process 600 (or a suitable path planning system) can apply the maneuvering primitive to the specific scenario (e.g., a specific speed and direction of the disturbance, trailer size, vessel size, vessel characteristics, etc.), which can be used to identify a suitable start pose (and, if applicable, intermediate poses) to accomplish the maneuver. In some embodiments, process 600 can cause guidance to be provided to an operator (e.g., using a graphical user interface) that can inform the operator about how to properly execute the maneuver after navigating to a start point/start pose for the maneuver.

At 608, process 600 can determine whether the vessel has reached the target location. If process 600 determines that the vessel has not reached the target location ("NO" at 608), process 600 can return to 602. For example, process 600 can determine whether the ambient conditions have changed, which may require a change in the target location identified at 604 and/or the path planned at 606.

Otherwise, if process 600 determines that the vessel has reached the target location ("YES" at 608), process 600 can move to 610.

At 610, process 600 can cause the vessel to maneuver from the target location to the target position at a predetermined speed. For example, as described above in connection with 408 and 410 of FIG. 4, process 600 can facilitate control of the marine vessel at the predetermined speed using information presented to the operator, such as information presented via a graphical user interface (e.g., presented at 408). As another example, as described above in connection with 410 of FIG. 4, process 600 can facilitate control of the marine vessel by an autonomy system of the marine vessel based on the path identified at 606. In some embodiments, 608 and/or 610 can be omitted (e.g., where environmental conditions are not updated, and/or where the target position and target location are co-located).

Figure 7:
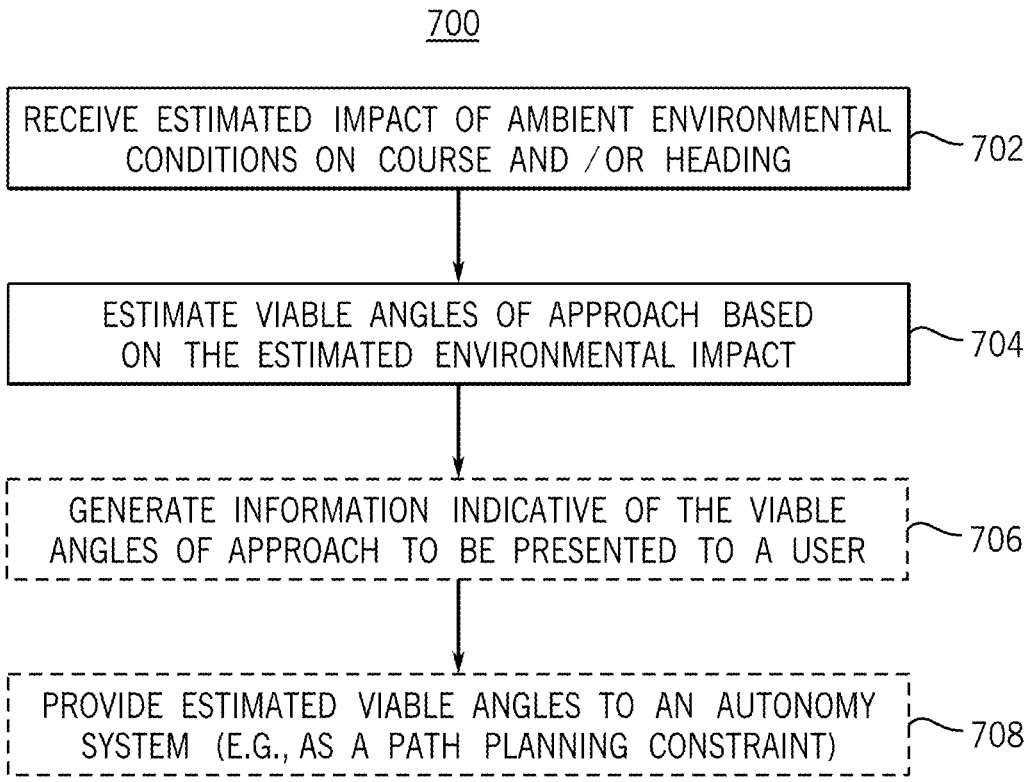
FIG. 7 shows an example of a process for determining a set of viable paths to a target location based on an estimated environmental disturbance on a course of the marine vessel in accordance with some embodiments of the disclosed subject matter.

FIG. 7 shows an example of a process for determining a set of viable paths to a target location based on an estimated environmental disturbance on a course of the marine vessel in accordance with some embodiments of the disclosed subject matter.

At 702, process 700 can receive an estimated impact of ambient environmental conditions on the course and/or heading of the marine vessel. In some embodiments, the estimated impact can be received from any suitable source, and/or can be determined using any suitable technique or combination of techniques. For example, the estimated impact of ambient environmental conditions can be an estimated impact calculated at 404.

At 704, process 700 can estimate a range of viable angles of approach to the storage structure based on the estimated environmental impact. In some embodiments, process 700 can identify a target position (e.g., a position at which the vessel is to be substantially aligned with the storage structure, such as the centerline of a trailer). For example, as described above in connection with FIG. 3E, the target position can be a point at which the centerline of a trailer intersects a perpendicular line at which the centerline of the vessel is expected to be substantially aligned with the centerline of the trailer (e.g., a point at which misalignment is likely to make it difficult to load the vessel onto the trailer), such as a point at which a line between rear-most points of raised guides intersect the centerline, or a point near which the centerline intersects the water. In some embodiments, the range of viable approach angles can include lines that intersect the target position, and that are generally aligned with a direction of the estimated environmental impact (e.g., with the wind/current, or against the wind/current). In some embodiments, a center of the range of viable angles can be aligned with an approach that generally aligns with an approach that is most likely to be navigated successfully (e.g., without backing off and approaching again, without a substantial risk of damage to the vessel or storage structure, etc.). For example, a difference in angle between alignment with the storage structure and the center of the of the range of viable angles (e.g., angle $\phi$ in FIG. 3E between trailer centerline 356 and cone centerline 354, or an angle between a longitudinal axis of a docking location and an angle of approach) can be determined based on the direction of the estimated environmental impact. In some embodiments, the alignment of the center of the range can vary based on whether the estimated environmental impact is toward or away from the target position, and the context (e.g., trailering, docking, etc.). For example, the angle can be smaller when approaching a trailer (or docking location, see, e.g., FIGS. 8A and 8C) with the wind/current, and larger when approaching a trailer (or docking location, see, e.g., FIGS. 8A and 8B) against the wind/current. As another example, the angle can be large when approaching a mooring ball or anchoring location with the wind/current (e.g., an operator can be directed to move around to put the mooring ball or anchoring location upwind), and smaller when approaching a mooring ball or anchoring location against the wind/current.

In some embodiments, the range of viable approach angles can a range of angles around the center of the range that are likely to be navigated successfully (e.g., a likelihood that the operate will need to off and approach again, and the likelihood damage to the vessel or storage structure, etc., is relatively low). For example, in FIG. 3E, a width of the cone (e.g., angle $\theta$) can be based on the magnitude of the disturbance, such that the cone is narrower for larger disturbances and wider for smaller disturbances. As another example, the size of the range (e.g., a width $\theta$ of the cone in FIG. 3E) can be based on a speed of the vessel, such that at the range is narrower at faster speed, and larger wider for slower speeds. As yet another example, the size of the range (e.g., a width $\theta$ of the cone in FIG. 3E) can be based on the presence of obstacles, such that the range of viable angles is at least a predetermined distance from any obstacles that may damage (and/or may be damaged by) the vessel.

In some embodiments, viable angles of approach identified at 704 can be represented by a shape (e.g., a 2D shape, a 3D shape, etc.) in any suitable coordinate system (e.g., a global coordinate system, a geographic coordinate system, a camera coordinate system, etc.). For example, viable angles of approach can be represented as a cone (e.g., cone 352 described above in connection with FIG. 3E).

At 706, process 700 can generate information indicative of the viable angles of approach to be presented to a user. In some embodiments, process 700 can draw a cone (or any other suitable shape, such as a triangle) on a representation of the environment (on an image from imaging device 72, on any other type of real-time visualization of the environment, on a chart, etc.). In such embodiments, a shape and orientation of an object representing the range of viable angles of approach can be transformed into a coordinate system of the representation of the environment (e.g., a camera coordinate system of the imaging device used to capture an image over which the object representing the range of viable angles of approach is to be drawn, a global coordinate system, etc.).

In some embodiments, process 700 can present a user interface that includes an illustration of the viable angles of approach on a representation of the environment, including the storage structure(s) and/or storage location at which the marine vessel is to be stored. For example, a user interface element (e.g., a cone, a triangle, two sides of a cone, multiple lines, shading, coloring, etc.) representing the viable angles of approach can be overlaid on a live image that includes the storage structure and/or storage location (e.g., captured by imaging device 72). In such an example, a user interface element (e.g., a line(s)) representing a centerline of the marine vessel can also be overlaid on the live image that includes the viable angles of approach and storage structure and/or location, which can provide visual feedback that facilitates alignment of the marine vessel with the representation of the viable angles of approach. As another example, a user interface element (e.g., a cone, a triangle, two sides of a cone, multiple lines, shading, coloring, etc.) representing the viable angles of approach can be overlaid on a model of the environment (e.g., a representation of an occupancy grid, a chart or map representing a position and orientation of the marine vessel and the environment, etc.). In some embodiments, 706 can be omitted (e.g., where the viable angles of approach are used by an autonomy system without operator intervention).

At 708, process 700 can provide the estimated viable angles to an autonomy system. For example, the viable angles of approach can be provided as a constraint on a path(s) planned/taken by an autonomy system. In some embodiments, 708 can be omitted (e.g., where an operator controls the marine vessel without intervention by an autonomy system).

Figure 8A:
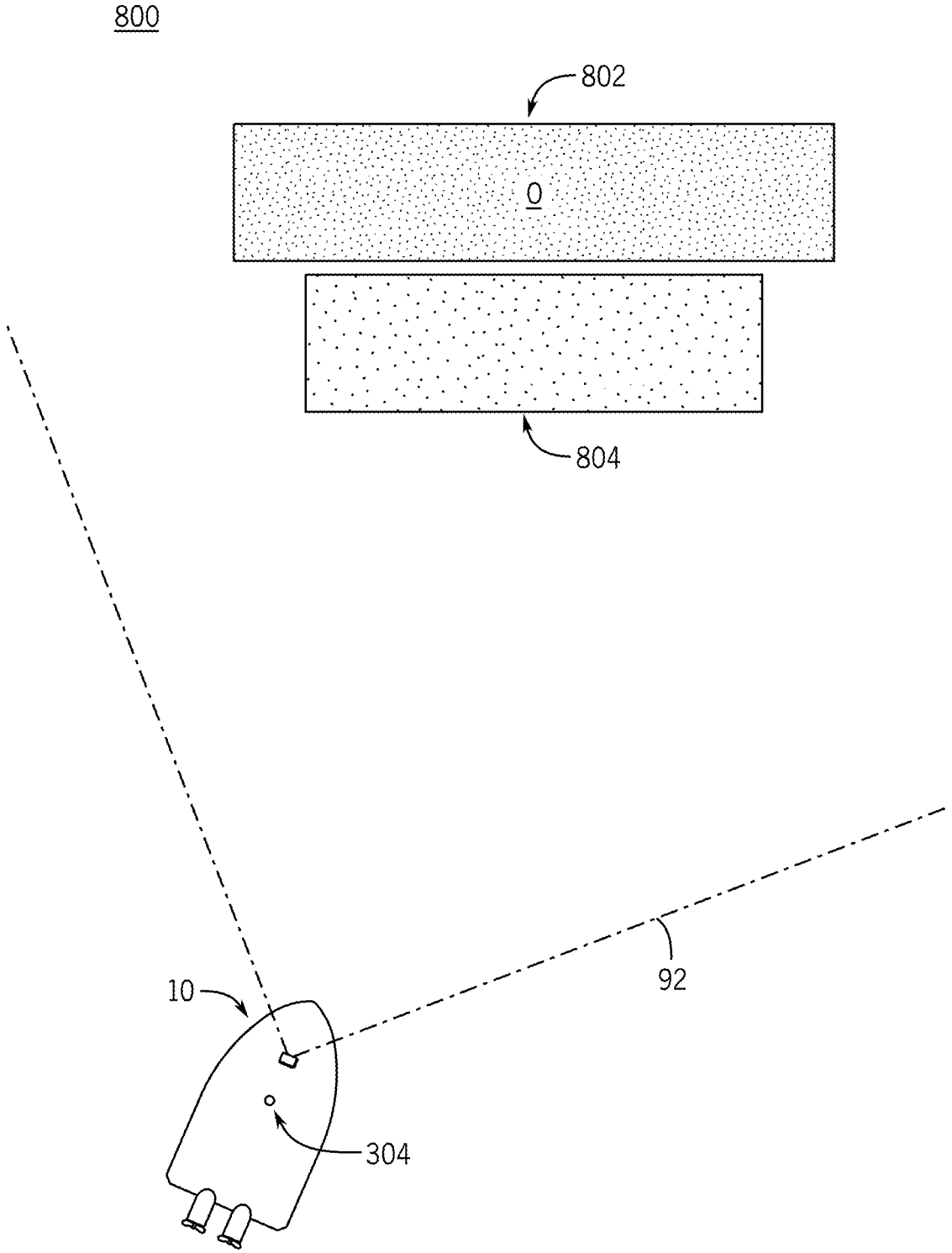
FIG. 8A shows an example of an environment in which a marine vessel can execute a process for maneuvering a marine vessel to a docking structure in accordance with some embodiments of the disclosed subject matter.

FIG. 8A shows an example of an environment 800 in which a marine vessel can execute a process for maneuvering a marine vessel to a docking structure in accordance with some embodiments of the disclosed subject matter.

In some embodiments, vessel 10 (e.g., via control system 220) can analyze environment 800 to estimate an impact that wind and/or water current is likely to have on vessel 10 as it is maneuvered toward a storage structure 802 (e.g., a dock) that includes a space 804 in which vessel 10 is to be stored (e.g., a berth). In the example of FIG. 8A, storage structure 802 is a dock, and vessel 10 is being docked at spot 804. Note that although FIG. 8A is described in connection with docking vessel 10 at a dock, mechanisms described herein can be used in connection with approaching any elongate structure at which a boat can be stored (e.g., temporarily or for a more extended period of time) parallel to the structure.

In some embodiments, vessel 10 can approach dock 802 manually (e.g., by an operator controlling propulsion using one or more input devices of operation console 22), autonomously (e.g., by an autonomy system controlling a propulsion device(s) of vessel 10), and/or semi-autonomously. In some embodiments, vessel 10 can estimate an impact of wind and/or water current on the course and/or heading of vessel 10, and can determine appropriate maneuvers that facilitate safely and efficiently navigating to a target position (e.g., space 804) at which vessel 10 is to be stored and/or secured.

In the example shown in FIG. 8A, vessel 10 can use any suitable technique or combination of techniques to estimate how ambient environmental conditions are likely to impact vessel 10, such as techniques described above in connection with FIGS. 4-7.

Figure 8B:
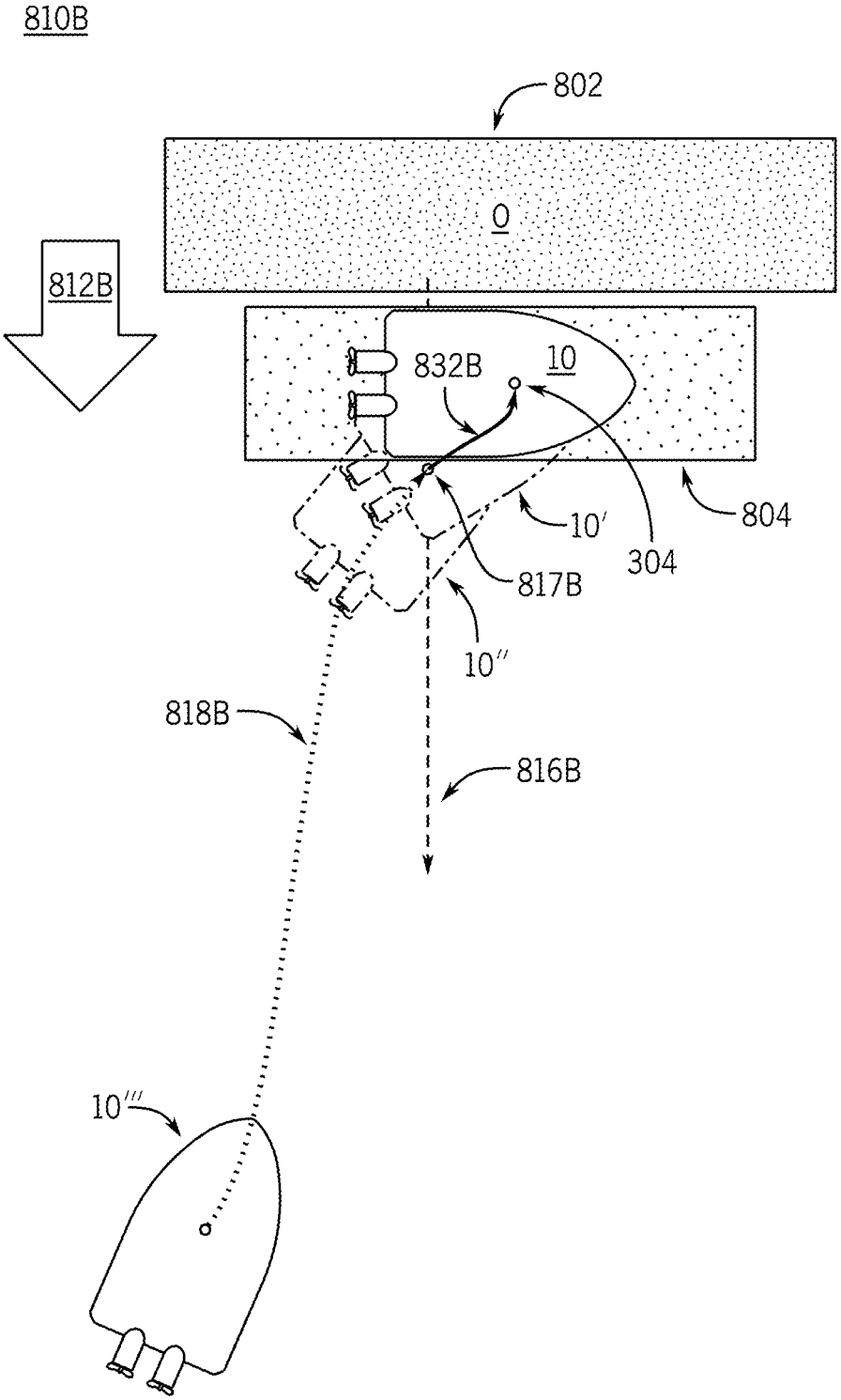
FIG. 8B shows an example in which the marine vessel has estimated an environmental disturbance pushing the marine vessel away from the docking structure and determined a path based on the environmental disturbance in accordance with some embodiments of the disclosed subject matter.

FIG. 8B shows an example in which the marine vessel has estimated an environmental disturbance pushing the marine vessel away from the docking structure and determined a path based on the environmental disturbance in accordance with some embodiments of the disclosed subject matter. In FIG. 8B, example 810B shows vessel 10 within space 804, and shows an outline 10' showing the original position of vessel 10, outlines 10" and 10'" showing different positions of vessel 10 as it approached spot 804.

In FIG. 8B, arrow 812B shows a general direction of an estimated environmental impact, and line 816B shows a direction of movement caused by the ambient environmental conditions. As shown in FIG. 8B, in conditions where the direction of the estimated environmental impact is generally from dock 802 toward vessel 10, approaching space 802 at a relatively steep angle (e.g., with the bow pointing toward a portion of space 804) and turning into space 804 as vessel 10 approaches dock 802 can increase the safety of docking into the wind. In FIG. 8B, vessel 10 followed a path 818B toward a target position 817B at which different maneuvers may be required (e.g., more aggressive turning, approaching at a lowest speed, an occupant of vessel 10 that has moved to dock 802 or a person on dock 802 using a line to manually maneuver vessel 10, using joystick 30, etc.). For example, vessel 10 can follow path 832B from target position 817B to space 804.

In some embodiments, mechanisms described herein can identify a path (or set of paths) appropriate for docking in space 804 based on the estimated environmental impact. Additionally or alternatively, in some embodiments, mechanisms described herein can present information (e.g., via a user interface) that indicates an appropriate approach to an operator. For example, mechanisms described herein can present a graphic showing a safe approach when environmental conditions are toward vessel 10, indicating that the approach is appropriate when docking into the wind and/or current, and indicating a direction of the wind and/or current (e.g., a general direction such as toward vessel 10 or toward dock 802, or a more specific direction such as a heading of the wind). As another example, mechanisms described herein can present a path for an operator to follow (e.g., overlaid on an image from an imaging device of vessel 10, on a graphical representation of the environment, etc.), indicating that the approach is appropriate when docking into the wind and/or current, and/or indicating a direction of the wind and/or current.

Figure 8C:
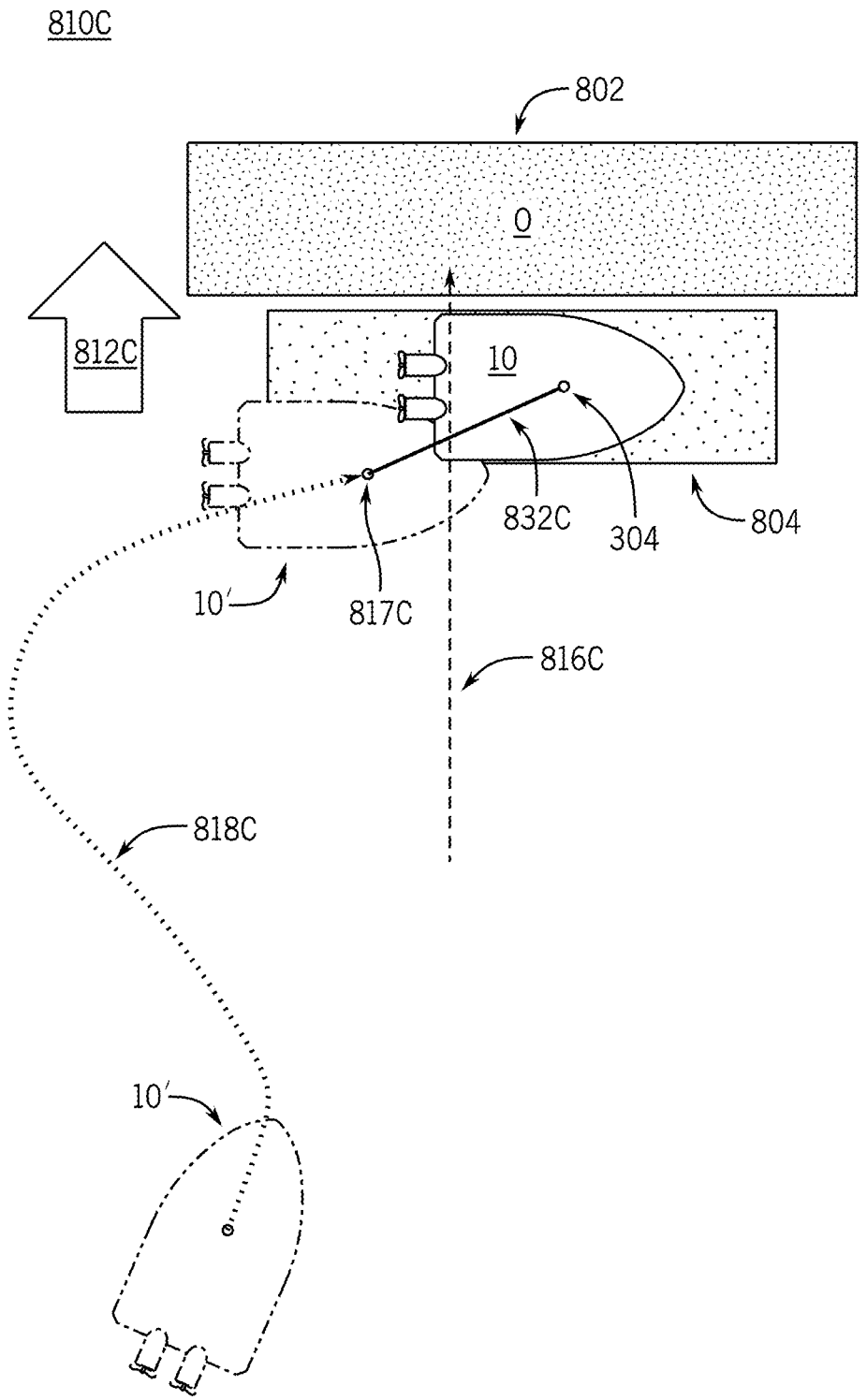
FIG. 8C shows an example in which the marine vessel has estimated an environmental disturbance pushing the marine vessel toward the docking structure and determined a path based on the environmental disturbance in accordance with some embodiments of the disclosed subject matter.

FIG. 8C shows an example in which the marine vessel has estimated an environmental disturbance pushing the marine vessel toward the docking structure and determined a path based on the environmental disturbance in accordance with some embodiments of the disclosed subject matter. In FIG. 8C, example 810C shows vessel 10 within space 804, and shows an outline 10' showing the original position of vessel 10, outlines 10" and 10'" showing different positions of vessel 10 as it approached spot 804.

In FIG. 8C, arrow 812C shows a general direction of an estimated environmental impact, and line 816C shows a direction of movement caused by the ambient environmental conditions. As shown in FIG. 8C, in conditions where the direction of the estimated environmental impact is generally moving vessel 10 toward dock 802, approaching space 804 at a relatively shallow angle (e.g., with the bow pointing along a length of space 804) and pulling into space 804 from the side as vessel 10 approaches dock 802 can increase the safety of docking with the wind. In FIG. 8C, vessel 10 followed a path 81CB toward a target position 817B at which different maneuvers may be appropriate (e.g., approaching at a lowest speed, drifting without thrust, an occupant of vessel 10 that has moved to dock 802 or a person on dock 802 using a line to manually maneuver vessel 10 into position, using joystick 30 to move laterally, etc.). For example, vessel 10 can follow path 832C from target position 817C to space 804.

In some embodiments, mechanisms described herein can identify a path (or set of paths) appropriate for docking in space 804 based on the estimated environmental impact. Additionally or alternatively, in some embodiments, mechanisms described herein can present information (e.g., via a user interface) that indicates an appropriate approach to an operator. For example, mechanisms described herein can present a graphic showing a safe approach when environmental conditions are toward vessel 10, indicating that the approach is appropriate when docking into the wind and/or current, and indicating a direction of the wind and/or current (e.g., a general direction such as toward vessel 10 or toward dock 802, or a more specific direction such as a heading of the wind). As another example, mechanisms described herein can present a path for an operator to follow (e.g., overlaid on an image from an imaging device of vessel 10, on a graphical representation of the environment, etc.), indicating that the approach is appropriate when docking into the wind and/or current, and/or indicating a direction of the wind and/or current.

Figure 9:
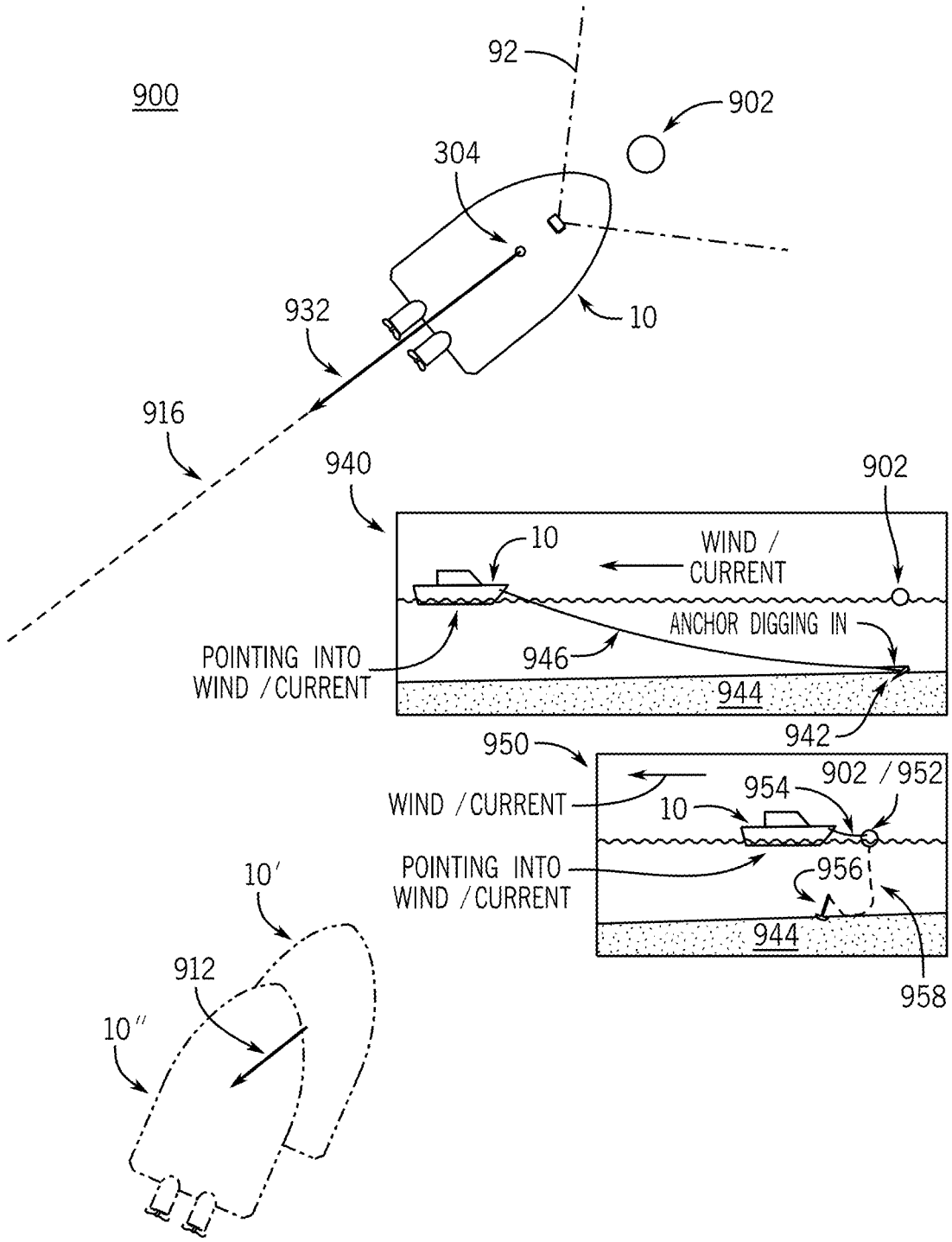
FIG. 9 shows an example of an environment in which a marine vessel can execute a process for maneuvering a marine vessel to an anchoring location or mooring ball in accordance with some embodiments of the disclosed subject matter.

FIG. 9 shows an example of an environment in which a marine vessel can execute a process for maneuvering a marine vessel to an anchoring location or mooring ball in accordance with some embodiments of the disclosed subject matter. In some embodiments, vessel 10 (e.g., via control system 220) can analyze environment 900 to estimate an impact that wind and/or water current is likely to have on vessel 10 as it is maneuvered toward a storage location 902 (e.g., a mooring ball, a position at which vessel 10 drops anchor).

In some embodiments, vessel 10 can approach storage location 902 manually (e.g., by an operator controlling propulsion using one or more input devices of operation console 22), autonomously (e.g., by an autonomy system controlling a propulsion device(s) of vessel 10), and/or semi-autonomously. In some embodiments, vessel 10 can estimate an impact of wind and/or water current on the course and/or heading of vessel 10, and can determine appropriate maneuvers that facilitate safely and efficiently securing vessel 10 at storage location 902. In the example shown in FIG. 9, vessel 10 can use any suitable technique or combination of techniques to estimate how ambient environmental conditions are likely to impact vessel 10, such as techniques described above in connection with FIGS. 4-7.

In FIG. 9, vessel 10 is near storage location 902, and outlines 10' and 10" show an earlier position of vessel 10 (e.g., when process 400 begins), and an intermediate position (e.g., a position after drifting from position 10' at 502 of FIG. 5), respectively. Note that if an environmental impact is determined using a techniques that does not include drifting, position 10' or 10" can be omitted.

In FIG. 9, vector 912 shows a direction (or direction and magnitude) of movement (e.g., in two dimensions) during a predetermined period of time in which movements of vessel 10 can be confidently attributed to environmental conditions (e.g., rather than a combination of environmental conditions and thrust from propulsion devices 12*a*, 12*b*). Additionally or alternatively, vector 912 shows a direction (or direction and magnitude) of an estimated impact of ambient environmental conditions (e.g., in two dimensions) estimated by vessel 10.

In some embodiments, mechanisms described herein can identify a path of movement 916 of vessel 10 due to ambient environmental conditions near storage location 902 (e.g., based on the direction or direction and magnitude of vector 912). In the example of FIG. 9, path of movement 916 is angled toward vessel, and vessel 10 (e.g., using controller 24, sensor process 70, etc.) can identify an angle of approach, and/or a path, to storage location 902 (or a heading, if vessel 10 is already at storage location 902) that facilitates safe and/or efficient mooring or anchoring at storage location 902. For example, an operator (or an autonomy system) can be instructed to approach storage location 902 from the direction in which path of movement 916 is pointing (e.g., downwind, downcurrent) and/or to align the heading of vessel 10 into the wind and/or current. In FIG. 9, when vessel 10 is aligned into the wind at storage location 902, an operator can secure vessel 10 to a mooring ball located at storage location 902, or an operator (and/or autonomy system) can drop anchor at storage location 902. After an anchor of vessel 10 has dropped, or vessel 10 has been moored to the mooring ball, ambient environmental conditions can be expected to push vessel 10 along a path 932, which can improve the safety and/or efficiency of mooring and/or anchoring.

For example, as shown in inset panel 940, if vessel 10 drops an anchor 942 to a floor 944 of the body of water near storage location 902, vessel 10 can move backward (e.g., in a direction of the stern) to cause anchor 942 to dig into floor 944, as an anchor line 946 pulls on anchor 942. If vessel 10 is aligned with a heading that is into the wind and/or current, ambient environmental conditions can be expected to not interfere with anchoring (e.g., the propulsion system can operate more efficiently if it does not need to overcome an unfavorable thrust from wind and/or current), or to assist with anchoring. Additionally, vessel 10 can be expected to remain in a relatively stable position after anchoring, whereas if vessel 10 is not aligned into the wind/current, vessel 10 may begin to drift in an undesirable direction after anchoring.

As another example, as shown in inset panel 940, if vessel 10 is moored to a mooring ball 952 at storage location 902 via one or more mooring lines 954 (e.g., which can be secured to floor 942 via an anchor 956 and a mooring chain 958), vessel 10 can move backward (e.g., in a direction of the stern). If vessel 10 is aligned with a heading that is into the wind and/or current, ambient environmental conditions can be expected to facilitate the safety and/or efficiency of mooring (e.g., forward thrust can be used as needed to keep vessel 10 near mooring ball 952 without moving in an undesirable direction). Additionally, vessel 10 can be expected to remain in a relatively stable position after mooring, whereas if vessel 10 is not aligned into the wind/current, vessel 10 may begin to drift in an undesirable direction after mooring.

Further Examples Having a Variety of Features

Implementation examples are described in the following numbered clauses:

1. A method for maneuvering a marine vessel to a target position, comprising: determining that the marine vessel is being secured at a target position; receiving, from a sensor, information indicative of an impact of one or more environmental influences on the marine vessel; estimating an environmental impact on a course of the marine vessel based on the information indicative of the impact of the one or more environmental influences on the marine vessel; determining a path to the target position based on the environmental impact; and causing the marine vessel to maneuver to the target position based on the path.
2. A method for maneuvering a marine vessel to a target position, the method comprising: determining that the marine vessel is being secured at a target position; receiving, from a sensor, information indicative of an impact of one or more environmental influences on the marine vessel; estimating an environmental impact on a course of the marine vessel based on the information indicative of the impact of the one or more environmental influences on the marine vessel; determining a path to the target position based on the environmental impact; determining marine vessel movements to cause the marine vessel to travel along the path based on the environmental impact; and outputting the marine vessel movements to a marine propulsion system comprising one or more propulsion devices, thereby causing the marine propulsion system to actuate the one or more propulsion devices to propel the marine vessel to the target position without further intervention from an operator of the marine vessel.
3. A method for maneuvering a marine vessel to a target position, comprising: determining that the marine vessel is being secured at a target position; receiving, from a sensor, information indicative of an impact of one or more environmental influences on the marine vessel; estimating an environmental impact on a course of the marine vessel based on the information indicative of the impact of the one or more environmental influences on the marine vessel; determining a path to the target position based on the environmental impact; and presenting, using a display device, a user interface element that prompts an operator of the marine vessel to control at least one propulsion device of the marine vessel to navigate.
4. The method of any one of clauses 1 to 3, further comprising: receiving image data from an imaging device, wherein the imaging device is configured to be mounted to the marine vessel with an associated field of view of a marine environment of the marine vessel; determining that the marine vessel is being trailered on a boat trailer; and identifying, based on the image data, a position associated with the boat trailer as the target position.
5. The method of any one of clauses 1 to 4, wherein the one or more environmental influences includes wind, and the environmental impact on the course of the marine vessel includes an impact of the wind on the course of the marine vessel.

6. The method of any one of clauses 1 to 5, further comprising: presenting, using a display device, a user interface element that represents the path and prompts an operator of the marine vessel to control at least one propulsion device of the marine vessel to navigate to the target position.

7. The method of any one of clauses 1 to 6, wherein the sensor comprises an imaging device, the imaging device is configured to be mounted to the marine vessel with an associated field of view of a marine environment of the marine vessel, and the information indicative of the impact of the one or more environmental influences on the marine vessel comprises image data generated by imaging device; and wherein the method further comprises: receiving, from the imaging device, a sequence of image data that includes at least one object in the marine environment; and estimating the environmental impact on the course of the marine vessel based on movement of the at least one object in the sequence of image data.

8. The method of clause 7, wherein the imaging device comprises a digital camera configured to generate a two-dimensional image of a portion of the marine environment within the associated field of view, and wherein the portion of the marine environment within the associated field of view includes a region forward of a bow of the marine vessel.

9. The method of any one of clauses 7 or 8, further comprising: determining movement of the at least one object during a period of time depicted in the sequence of images based on an optical flow of at least one point of interest on the at least one object in the sequence of image data.

10. The method of clause 9, further comprising: causing the marine vessel to drift for at least a predetermined period of time, including the period of time depicted in the sequence of images; determining ego motion of the marine vessel during the period of time depicted in the sequence based on the movement of the at least one object during the period of time depicted in the sequence; and estimating the environmental impact on the course of the marine vessel based on the ego motion of the marine vessel during the period of time depicted in the sequence.

11. The method of any one of clauses 9 or 10, wherein the at least one object includes a wave; and wherein the method further comprises: determining movement of the wave during the period of time depicted in the sequence based on an optical flow of a point of interest on the wave in the sequence of image data; and estimating the environmental impact on the course of the marine vessel based on the movement of the wave during the period of time depicted in the sequence.

12. The method of any one of clauses 1 to 11, wherein the sensor comprises a wind sensor; and wherein the method further comprises: receiving, from the sensor, wind data; and estimating the environmental impact on the course of the marine vessel based on the wind data.

13. The method of any one of clauses 1 to 12, further comprising: identifying a target location in a marine environment of the marine vessel that facilitates securing the marine vessel at the target position using only input from a first input device manipulatable to provide user control input to control thrust of a propulsion device of the marine vessel, without input to a second input device manipulatable to provide user control input to control steering of the propulsion device; and determining a path to the target location based on the environmental impact.

14. The method of clause 13, wherein a direction of the environmental impact is toward the target position, and the target location is a location from which the environmental impact is predicted to cause the marine vessel to drift to the target position; and wherein the method further comprises: determining a first portion of the path to the target position based on the environmental impact and the target location; determining that the marine vessel has reached the target location; and in response to determining that the marine vessel has reached the target location, causing the marine vessel to drift to the target position.

15. The method of clause 14, further comprising: presenting, using a display device, a visualization of the first portion of the path; and in response to determining that the marine vessel has reached the target location, prompting, using the display device, an operator of the marine vessel to control at least one propulsion device of the marine vessel to allow the marine vessel to drift.

16. The method of any one of clauses 1 to 15, further comprising identifying a set of approach angles to the target position that facilitate securing the marine vessel at the target position based on the environmental impact, wherein the set of approach angles comprises the path to the target position and a plurality of other viable paths to the target position.

17. The method of clause 16, further comprising: presenting, using a display device, a visualization of the set of approach angles to the target position using the display device as a portion of a cone.

18. The method of any one of clauses 1 to 17, further comprising determining that the marine vessel is being docked at a dock; and identifying appropriate maneuvers to approach the dock based on the environmental impact, wherein the appropriate maneuvers facilitate safe docking of the marine vessel based on a prevailing direction of the environmental impact.

19. The method of clause 18, further comprising: presenting, using the display device, a visualization of appropriate maneuvers.

20. The method of any one of clauses 1 to 19, further comprising determining that the marine vessel is being moored at a mooring ball, wherein the target position is a position associated with the mooring ball; and identifying appropriate maneuvers to approach the mooring ball based on the environmental impact, wherein the appropriate maneuvers facilitate approaching the mooring ball from a direction that is opposite of a direction of the environmental impact, and the environmental impact is predicted to cause the marine vessel to drift in an aft direction away from the mooring ball.

21. The method of any one of clauses 1 to 20, further comprising determining that the marine vessel is being anchored, wherein the target position is a position at which an anchor is dropped during anchoring; and identifying appropriate maneuvers to approach the target position based on the environmental impact, wherein the appropriate maneuvers facilitate approaching the target position from a direction that is opposite of a direction of the environmental impact.

22. The method of clause 21, further comprising causing the marine vessel to maneuver in a reverse direction away from the target position, such that the anchor digs into a floor of a body of water in which the marine vessel is being anchored.

23. A system comprising: one or more processors configured to: perform a method of any of clauses 1 to 22.

24. A non-transitory computer-readable medium storing computer-executable code, comprising code for causing a computer to cause a processor to: perform a method of any of clauses 1 to 22.

In some embodiments, any suitable computer readable media can be used for storing instructions for performing functions and/or processes described herein. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as RAM, Flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, or any suitable media that is fleeting and devoid of any semblance of permanence during transmission, and/or any suitable intangible media.

It should be noted that, as used herein, the term mechanism can encompass hardware, software, firmware, or any suitable combination thereof.

It should be understood that above-described steps of the processes of FIGS. 4-7 can be executed or performed in any suitable order or sequence not limited to the order and sequence shown and described in the figures. Also, some of the above steps of the processes of FIGS. 4-7 can be executed or performed substantially simultaneously where appropriate or in parallel to reduce latency and processing times.

This written description uses examples to disclose the invention(s), including the best mode, and also to enable any person skilled in the art to make and use the invention(s). Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention(s) is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A system for maneuvering a marine vessel to a target position, the system comprising:

a sensor, wherein the sensor comprises an imaging device, the imaging device is configured to be mounted to the marine vessel with an associated field of view of a marine environment of the marine vessel;

a marine propulsion system comprising one or more propulsion devices; and one or more hardware processors configured to:

determine that the marine vessel is being secured at a target position;

output instructions to the marine propulsion system that cause the marine vessel to drift for at least a predetermined period of time;

receive, from the sensor, information indicative of an impact of one or more environmental influences on the marine vessel, wherein the information indicative of the impact of the one or more environmental influences on the marine vessel comprises a sequence of image data, generated by the imaging device during the predetermined period of time, that includes at least one object in the marine environment;

determine movement of the at least one object during a period of time depicted in the sequence of images based on an optical flow of at least one point of interest on the at least one object in the sequence of image data;

determine ego motion of the marine vessel during the period of time depicted in the sequence based on the movement of the at least one object during the period of time depicted in the sequence;

estimate an environmental impact on a course of the marine vessel based on the ego motion of the marine vessel during the period of time depicted in the sequence;

determine a path to the target position based on the environmental impact;

determine marine vessel movements to cause the marine vessel to travel along the path based on the environmental impact; and output the marine vessel movements to the marine propulsion system, thereby causing the marine propulsion system to actuate the one or more propulsion devices to propel the marine vessel to the target position without further intervention from an operator of the marine vessel.

2. The system of claim 1, further comprising:

a vision system comprising a plurality of imaging devices including the imaging device, wherein each of the plurality of imaging devices is configured to be mounted to the marine vessel with an associated field of view of a marine environment of the marine vessel; and wherein the one or more hardware processors are further configured to:

receive image data from an imaging device of the plurality of imaging devices;

determine that the marine vessel is being trailered on a boat trailer; and identify, based on the image data, a position associated with the boat trailer as the target position.

3. The system of claim 1, wherein the one or more environmental influences includes wind, and the environmental impact on the course of the marine vessel includes an impact of the wind on the course of the marine vessel.

4. The system of claim 1, wherein the imaging device comprises a digital camera configured to generate a two-dimensional image of a portion of the marine environment within the associated field of view, and wherein the portion of the marine environment within the associated field of view includes a region forward of a bow of the marine vessel.

5. The system of claim 1, wherein the at least one object includes a wave; and wherein the one or more hardware processors are further configured to:

determine movement of the wave during the period of time depicted in the sequence based on an optical flow of a point of interest on the wave in the sequence of image data; and estimate the environmental impact on the course of the marine vessel based on the movement of the wave during the period of time depicted in the sequence.

6. The system of claim 1, wherein the imaging device comprises a stereoscopic depth camera configured to generate three-dimensional data of a portion of the marine environment within the associated field of view, and wherein the portion of the marine environment within the associated field of view includes a region forward of a bow of the marine vessel; and wherein the one or more hardware processors are further configured to:

determine movement of the at least one object during a period of time depicted in the sequence of images based on a first 3D location of at least one point of interest on the at least one object at a beginning of the sequence of images and a second 3D location of the least one point of interest on the at least one object at an end of the sequence of images.

7. The system of claim 1, wherein the sensor comprises a wind sensor; and wherein the one or more hardware processors are further configured to:

receive, from the sensor, wind data; and estimate the environmental impact on the course of the marine vessel based on the wind data.

8. The system of claim 1, wherein the one or more hardware processors are further configured to:

identify a target location in a marine environment of the marine vessel that facilitates securing the marine vessel at the target position using only thrust commands to the one or more propulsion devices, without steering commands, wherein a direction of the environmental impact is toward the target position, and the target location is a location from which the environmental impact is predicted to cause the marine vessel to drift to the target position;

determine a first portion of the path to the target position based on the environmental impact and the target location;

determine that the marine vessel has reached the target location; and in response to determining that the marine vessel has reached the target location, output instructions to the marine propulsion system that cause the marine vessel to drift to the target position.

9. The system of claim 1, wherein the one or more hardware processors are further configured to:

identify a set of approach angles to the target position that facilitate securing the marine vessel at the target position based on the environmental impact, wherein the set of approach angles comprises the path to the target position and a plurality of other viable paths to the target position.

10. The system of claim 9, wherein the one or more hardware processors are further configured to:

determine the path to the target position using the set of approach angles as a constraint.

11. The system of claim 1, wherein the one or more hardware processors are further configured to:

determine that the marine vessel is being docked at a dock;

identify appropriate maneuvers to approach the dock based on the environmental impact, wherein the appropriate maneuvers facilitate safe docking of the marine vessel based on a prevailing direction of the environmental impact; and determine the path based on the appropriate maneuvers.

12. The system of claim 1, wherein the one or more hardware processors are further configured to:

determine that the marine vessel is being moored at a mooring ball, wherein the target position is a position associated with the mooring ball;

identify appropriate maneuvers to approach the mooring ball based on the environmental impact, wherein the appropriate maneuvers facilitate approaching the mooring ball from a direction that is opposite of a direction of the environmental impact, and the environmental impact is predicted to cause the marine vessel to drift in an aft direction away from the mooring ball; and determine the path based on the appropriate maneuvers.

13. The system of claim 1, wherein the one or more hardware processors are further configured to:

determine that the marine vessel is being anchored, wherein the target position is a position at which an anchor is dropped during anchoring;

identify appropriate maneuvers to approach the target position based on the environmental impact, wherein the appropriate maneuvers facilitate approaching the target position from a direction that is opposite of a direction of the environmental impact; and determine the path based on the appropriate maneuvers.

14. The system of claim 13, wherein the one or more hardware processors are further configured to:

output marine vessel movements to the marine propulsion system that cause the marine vessel to maneuver in a reverse direction away from the target position subsequent to the anchor being deployed at the target position, such that the anchor digs into a floor of a body of water in which the marine vessel is being anchored.

15. The system of claim 1, wherein the one or more hardware processors are further configured to:

estimate a disturbance force on the marine vessel based on an angle of attack of the marine vessel with respect to a direction of the environmental impact; and determine the path to the target position based on the estimated disturbance.

16. The system of claim 15, wherein the one or more hardware processors are further configured to:

determine the angle of attack of the marine vessel with respect to the direction of the environmental impact based on a heading of the marine vessel and a vector that represents the environmental impact.

17. A method for maneuvering a marine vessel to a target position, comprising:

determining that the marine vessel is being secured at a target position;

outputting instructions to a marine propulsion system that cause the marine vessel to drift for at least a predetermined period of time;

receiving, from a sensor, information indicative of an impact of one or more environmental influences on the marine vessel, wherein the sensor comprises an imaging device, the imaging device is configured to be mounted to the marine vessel with an associated field of view of a marine environment of the marine vessel; and wherein the information indicative of the impact of the one or more environmental influences on the marine vessel comprises a sequence of image data, generated by the imaging device during the predetermined period of time, that includes at least one object in the marine environment;

determining movement of the at least one object during a period of time depicted in the sequence of images based on an optical flow of at least one point of interest on the at least one object in the sequence of image data;

determining ego motion of the marine vessel during the period of time depicted in the sequence based on the movement of the at least one object during the period of time depicted in the sequence;

estimating an environmental impact on a course of the marine vessel based on the ego motion of the marine vessel during the period of time depicted in the sequence;

determining a path to the target position based on the environmental impact;

determining marine vessel movements to cause the marine vessel to travel along the path based on the environmental impact; and outputting the marine vessel movements to the marine propulsion system comprising one or more propulsion devices, thereby causing the marine propulsion system to actuate the one or more propulsion devices to propel the marine vessel to the target position without further intervention from an operator of the marine vessel.

18. A system for maneuvering a marine vessel to a target position, the system comprising:

a sensor;

a marine propulsion system comprising one or more propulsion devices; and one or more hardware processors configured to:

determine that the marine vessel is being moored at a target position associated with a mooring ball;

receive, from the sensor, information indicative of an impact of one or more environmental influences on the marine vessel;

estimate an environmental impact on a course of the marine vessel based on the information indicative of the impact of the one or more environmental influences on the marine vessel;

identify appropriate maneuvers to approach the mooring ball based on the environmental impact, wherein the appropriate maneuvers facilitate approaching the mooring ball from a direction that is opposite of a direction of the environmental impact, and the environmental impact is predicted to cause the marine vessel to drift in an aft direction away from the mooring ball;

determine a path to the target position based on the appropriate maneuvers;

determine marine vessel movements to cause the marine vessel to travel along the path based on the environmental impact; and output the marine vessel movements to the marine propulsion system, thereby causing the marine propulsion system to actuate the one or more propulsion devices to propel the marine vessel to the target position without further intervention from an operator of the marine vessel.

19. The system of claim 18, wherein the sensor comprises an imaging device, the imaging device is configured to be mounted to the marine vessel with an associated field of view of a marine environment of the marine vessel, and the information indicative of the impact of the one or more environmental influences on the marine vessel comprises image data generated by imaging device; and wherein the one or more hardware processors are further configured to:

receive, from the imaging device, a sequence of image data that includes at least one object in the marine environment; and estimate the environmental impact on the course of the marine vessel based on movement of the at least one object in the sequence of image data.

20. The system of claim 19, wherein the imaging device comprises a stereoscopic depth camera configured to generate three-dimensional data of a portion of the marine environment within the associated field of view, and wherein the portion of the marine environment within the associated field of view includes a region forward of a bow of the marine vessel; and wherein the one or more hardware processors are further configured to:

determine movement of the at least one object during a period of time depicted in the sequence of images based on a first 3D location of at least one point of interest on the at least one object at a beginning of the sequence of images and a second 3D location of the least one point of interest on the at least one object at an end of the sequence of images.

* * * * *